US007307607B2

(12) United States Patent
Osame et al.

(10) Patent No.: US 7,307,607 B2
(45) Date of Patent: Dec. 11, 2007

(54) PASSIVE MATRIX LIGHT EMITTING DEVICE

(75) Inventors: Mitsuaki Osame, Kanagawa (JP); Jun Koyama, Kanagawa (JP)

(73) Assignee: Semiconductor Energy Laboratory Co., Ltd., Kanagawa-Ken (JP)

( * ) Notice: Subject to any disclaimer, the term of this patent is extended or adjusted under 35 U.S.C. 154(b) by 260 days.

(21) Appl. No.: 10/428,831

(22) Filed: May 5, 2003

(65) Prior Publication Data

US 2003/0214521 A1 Nov. 20, 2003

(30) Foreign Application Priority Data

May 15, 2002 (JP) ..... 2002-139510
May 17, 2002 (JP) ..... 2002-142528

(51) Int. Cl.
*G09G 3/30* (2006.01)

(52) U.S. Cl. ..... 345/77; 345/76; 315/169.3

(58) Field of Classification Search ..... 345/76–84
See application file for complete search history.

(56) References Cited

U.S. PATENT DOCUMENTS

| | | | |
|---|---|---|---|
| 5,247,190 | A | 9/1993 | Friend et al. |
| 5,399,502 | A | 3/1995 | Friend et al. |
| 5,708,451 | A | 1/1998 | Baldi |
| 5,778,146 | A | 7/1998 | Kawasaki et al. |
| 6,127,991 | A | 10/2000 | Uehara et al. |
| 6,219,017 | B1 | 4/2001 | Shimada et al. |
| 6,249,268 | B1 | 6/2001 | Tachibana et al. |
| 6,456,337 | B1 | 9/2002 | Kobayashi et al. |

(Continued)

FOREIGN PATENT DOCUMENTS

EP 1 103 946 A2 5/2001

(Continued)

OTHER PUBLICATIONS

T. Tsutsui et al. "High Quantum Efficiency in Organic Light-Emitting Devices with Iridium-Complex as a Triplet Emissive Center" Jpn. J. Appl. Phys. vol. 38 (1999) pp. L1502-L1504 (Part 2, 12B, Dec. 15, 1999).

(Continued)

*Primary Examiner*—Duc Dinh
(74) *Attorney, Agent, or Firm*—Nixon Peabody LLP; Jeffrey L. Costellia

(57) ABSTRACT

To provide a passive self-luminous device having a function for correcting a degradation of a light emitting element, which is capable of performing display with uniformity across a screen without occurrence of brightness variance. A counter counts an accumulated illumination time or an accumulated illumination time and illumination intensity in each pixel using a first image signal to store the count result in a volatile memory or a non-volatile memory. In a correction circuit, from the accumulated illumination time or the accumulated illumination time and illumination intensity, the first image signal is corrected according to a degree of degradation of each light emitting element based on correction data stored in advance in a correction data storage unit, to obtain a second image signal. With the second image signal, it is possible to eliminate the brightness variance and obtain a display with a uniformity across the screen in a display device, even when a light emitting element in a portion of pixels is degraded.

48 Claims, 16 Drawing Sheets

U.S. PATENT DOCUMENTS

| | | | | |
|---|---|---|---|---|
| 6,473,065 | B1 | 10/2002 | Fan | |
| 6,518,962 | B2 * | 2/2003 | Kimura et al. | 345/211 |
| 6,542,260 | B1 | 4/2003 | Gann et al. | |
| 6,618,084 | B1 | 9/2003 | Rambaldi et al. | |
| 6,628,848 | B1 | 9/2003 | Nakamura | |
| 6,897,842 | B2 * | 5/2005 | Gu | 345/90 |
| 2002/0033783 | A1 * | 3/2002 | Koyama | 345/82 |
| 2003/0063053 | A1 | 4/2003 | Yamazaki et al. | |
| 2003/0071804 | A1 | 4/2003 | Yamazaki et al. | |

FOREIGN PATENT DOCUMENTS

| | | |
|---|---|---|
| JP | 11-305722 | 11/1999 |
| JP | 2001-34933 | 12/2001 |
| JP | 2002-175041 | 6/2002 |

OTHER PUBLICATIONS

T. Tsutsui et al. "Electroluminescence in Organic Thin Films" ed. K. Honda "Photochemical Processes in Organized Molecular Systems" Elsevier Sci. Pub., Tokyo, 1991) pp. 437-450.

M.A. Baldo et al. "Highly efficient phosphorescent emission from organic electroluminescent devices" Nature, vol. 395, Sep. 1998, pp. 151-154.

M.A. Baldo et al. "Very high-efficiency green organic light-emitting devices based on electrophosphorescence" Applied Physics Letters, vol. 75, No. 1, Jul. 5, 1999 pp. 4-6.

T. Shimoda et al., "Current Status and Future of Light-Emitting Polymer Display Driven by Poly-Si TFT", SID Digest '99, SID International Symposium Digest of Technical Papers—May 18-20, 1999, pp. 372-375 (1999).

T. Shimoda et al., " High Resolution Light Emitting Polymer Display Driven by Low Temperature Polysilicon Thin Film Transistor with Integrated Driver", Asia Display '98, Proceedings of the 18th IDRC (International Display Research Conference) pp. 217-220 (1998).

Chang Wook Han et al., "3.8 □ Green OLED with low Temperature poly Si TFT", EuroDisplay '99: Proceedings of the 19th IDRC (International Display Research Conference) Late-news papers, Sep. 6-9, 1999, pp. 27-30 (1999).

* cited by examiner

PASSIVE MATRIX LIGHT EMITTING DEVICE

BACKGROUND OF THE INVENTION

1. Field of the Invention

The present invention relates to a passive matrix light emitting device. In particular, the present invention relates to a passive matrix light emitting device using a light emitting element represented by an organic electroluminescence (EL) element for a pixel portion.

2. Description of the Related Art

In recent years, as a flat display replacing a liquid crystal display (LCD), a light emitting device with an applied light emitting material such as organic electroluminescence (EL) attracts attention, and intensive studies are performed thereto.

FIG. 5 shows an outline of a conventional light emitting device in which digital gray scale display is performed. Here, a description will be given on an example of a light emitting device that uses an organic electroluminescent material (hereinafter, abbreviated simply as EL). The light emitting device shown in FIG. 5 has a pixel portion arranged in the center of a substrate 501 made of glass or the like. The pixel portion has light emitting elements, column signal lines, and row signal lines formed thereon. A column signal line driver circuit 502 for controlling the column signal lines is disposed on the upper side of the substrate 501. On the left side thereof is disposed a row signal line driver circuit 503 for controlling the row signal lines. Note that the column signal line driver circuit 502 and the row signal line driver circuit 503 are each composed of LSI chips, and connected to the substrate 501 through a flexible print circuit (FPC).

Referring to FIG. 5, the operation of a passive matrix light emitting device that performs digital gray scale display will be described. First, a row signal line 520 in the first row is selected. A state of being selected means here that a switch 512 is connected to GND. Next, switches 508 to 511 of the column driver circuit are turned ON. Terminals of the switches 508 to 511 on one end are connected to constant current sources 504 to 507, and terminals thereof on the other end are connected to column signal lines 516 to 519, respectively. When the switches 508 to 511 are turned ON, currents outputted from the current sources 504 to 507 flow into light emitting elements 524 to 527 via the switches 508 to 511 and column signal lines 516 to 519. Then, passing through the light emitting elements 524 to 527, the currents further pass through the switch 512 via the row signal line 520, and finally flow into GND. In this way, the light emitting elements 524 to 527 emit light in response to the flow of current therethrough. Time periods for which the switches 508 to 511 are turned ON vary from each other. Gray scale display is thus performed based on the length of time period for which the switch is turned ON. After the switches 508 to 511 are all turned OFF, the switch 512 of the row signal line driver circuit becomes in a state of VCC connection. Next, a switch 513 becomes in a state of GND connection, and this operation will be repeated. In a case where a switch of the row signal line driver circuit is in VCC connection, a light emitting element of the row interested is applied with a reverse bias, so that no current flows, and no light is emitted.

The brightness of light emitting elements 524 to 539, that is, the amount of current flowing in the light emitting elements 524 to 539 can be respectively controlled by the current value of the constant current sources 504 to 507 of the column signal line driver circuit and the length of time period for which the switches 508 to 511 are turned ON. FIG. 6 shows an example of the column signal line driver circuit. A constant voltage is first generated with a built-in constant voltage source. As the constant voltage source, a known band gap regulator or the like is used in many cases. In addition, a power source with a small temperature coefficient is used. The constant voltage generated is converted into a current by an operational amplifier 602, a transistor 603, and a resistance 604. Thus, a constant current with a small temperature coefficient can be generated. The current is reversed and duplicated to obtain plural currents by a current mirror circuit composed of transistors 605 to 609 and resistances 614 to 618, before being supplied to the column signal lines via switches 610 to 613.

Digital gray scale display of a light emitting element is described here. In the column signal line driver circuit shown in FIG. 5, if there is no variation in the length of ON time period for the switches 508 to 511, only two gray scales can be obtained in this light emitting device. A representation method of the gray scale in this light emitting device is described with reference to FIG. 7.

A timing chart of a digital time-division gray scale method is simply illustrated in FIG. 7. In this example, a frame frequency is set to 60 Hz, and 3-bit gray scale is obtained according to the time gray scale method. When the frame frequency is 60 Hz, one frame period is 16.6 ms. The value found by dividing this frame period by the number of pixels in the vertical direction approximately equals one horizontal line period. In a case where the number of pixels in the vertical direction is 220, for example, one horizontal line period takes 75 μs. In the above-mentioned method, if 90% of this horizontal line period is an image period, for which an image signal exists, the image period is 68 μs. In a case of performing 3-bit gray scale display, that is, display in eight gray scales in this image period, the length of ON time period for the switch may be set in proportion to gray scales, as illustrated in FIG. 7.

In the digital time gray scale method, the gray scale representation is conducted in the manner described above. It is of course possible to conduct the same kind of gray scale representation in a light emitting device for a color display.

Next, FIG. 14 shows an outline of a conventional light emitting device in which analog gray scale display is performed. A description will now be given on an example of a light emitting device that uses an organic EL material (hereinafter, simply abbreviated to EL). The light emitting device shown in FIG. 14 has a pixel portion arranged in the center of a substrate 1401 made of glass or the like. The pixel portion has light emitting elements, column signal lines, and row signal lines formed thereon. A column signal line driver circuit 1402 for controlling the column signal lines is disposed on the upper side of the substrate 1401. On the left side thereof is disposed a row signal line driver circuit 1403 for controlling the row signal lines. The column signal line driver circuit 1402 and the row signal line driver circuit 1403 are each composed of LSI chips, and connected to the substrate 1401 through a flexible print circuit (FPC).

Referring to FIG. 14, the operation of a passive matrix light emitting device that performs analog gray scale display will be described. First, a row signal line 1416 in the first row is selected. A state of being selected means here that a switch 1408 is connected to GND. Next, currents outputted from variable current sources 1404 to 1407 of the column driver circuit flow into light emitting elements 1420 to 1423 via column signal lines 1412 to 1415. Then, passing through the light emitting elements 1420 to 1423, the currents further pass through the switch 1408 via a row signal line 1416, and finally flow into GND. In this way, the light emitting elements 1420 to 1423 emit light in response to the flow of current therethrough. The current values of the variable current sources 1404 to 1407 are controlled in accordance with externally provided image data, and a display device performs gray scale display. After the one line period, the switch 1408 of the row signal line driver circuit becomes in a state of VCC connection. Next, a switch 1409 becomes in a state of GND connection, and this operation will be repeated. In a case where a switch of the row signal line driver circuit is in VCC connection, a light emitting element of the row interested is applied with a reverse bias, so that no current flows, and no light is emitted.

The brightness of light emitting elements 1420 to 1435, that is, the amount of current flowing in the light emitting elements 1420 to 1435 can be respectively controlled by the current value of the variable current sources 1404 to 1407 of the column signal line driver circuit. FIG. 15 shows an example of the column signal line driver circuit. First, an analog image signal is sampled by sampling switches 1509 to 1512 using sampling pulses of shift register output signals or the like. The sampled signals are retained by analog memories 1505 to 1508. When completing sampling of the signals in one line, the signals are transferred to analog memories 1521 to 1524 in response to a transfer pulse. Analog voltages thus obtained are inputted to the variable current sources composed of transistors 1501 to 1504 and resistances 1505 to 1508. The variable current sources output to the column signal lines currents corresponding to the inputted voltages.

Incidentally, problems are mentioned concerning a light emitting device using self-luminous elements such as light emitting elements. As described above, in a time period for which a light emitting element emits light, a current is always supplied and flows in the light emitting element. Therefore, if such an illumination continues for a long time, the property of light emitting element itself is degraded, which leads to the change of brightness characteristics. That is, the brightness of light emitted from a degraded light emitting element and the brightness of light from a non-degraded light emitting element vary from each other even when a current from the same current source is supplied thereto.

An explanation is made with a specific example. FIG. 10A shows a display screen of a mobile terminal device or the like using a light emitting device. In the display screen, operational icons 1001 are displayed. For the application of such a device, in many-cases, a still image is displayed most often in the screen. At this time, if the icons etc. are displayed in a color (gray scale) brighter than the background, light emitting elements in pixels of areas corresponding to the displayed icons emit light for a longer time than light emitting elements in pixels of areas for the background, and are thus degraded more quickly.

It is assumed here that the degradation of the light emitting element proceeds in the above-mentioned conditions. FIGS. 10B and 10C show display examples of the light emitting device after light emitting elements thereof are degraded. First, in such black display as shown in FIG. 10B, self-luminous elements represented by light emitting elements express the color of black in a state with no voltage applied thereto. Therefore, the degradation is not so conspicuous in the black display. On the other hand, in a case of a white display, a brightness variance occurs in the screen due to the lack of brightness in the degraded light emitting elements resulting from long time illumination (in this case, the light emitting elements in positions for displaying icons etc.) as denoted by reference numeral 1011 in FIG. 10C, even when the same current is supplied to the light emitting elements.

In order to eliminate the brightness variance, there is a method of applying more current to a degraded light emitting element. However, a current supply line is generally composed of a single wiring in a light emitting device, and also, in a driver circuit, it is difficult to form an additional circuit for changing an applied current to the light emitting element in a specific pixel among pixels arranged in matrix.

As another method to solve the problem, a method could be considered in which a light emitting element having a property coping with long time illumination is used.

SUMMARY OF THE INVENTION

Under the above circumstances, the present invention has been made, and an object thereof is to provide a light emitting device capable of performing a normal image display without a brightness variance even in a case where a light emitting element is degraded, by using a novel circuit.

To solve the above-mentioned problem, the following measures are implemented in the present invention.

According to the present invention, a light emitting device has a degradation correction function in which: image signals are periodically sampled to detect an illumination time in each pixel or an illumination time and illumination intensity therein; the accumulation of detected values and data on change of brightness characteristics with time of a light emitting element, which is stored in advance, are referred to; and the image signal for driving a pixel having a degraded light emitting element is corrected as occasion demands. With the degradation correction function, it becomes possible to keep the uniformity of brightness across the screen without the occurrence of brightness variance even when a portion of light emitting elements in the pixel is degraded.

Hereinafter, the structure of the passive matrix light emitting device of the present invention is described.

According to an aspect of the present invention, a passive matrix light emitting device receiving an image signal as an input to display an image, includes:

means for detecting an accumulated illumination time in each pixel from the image signal inputted;

means for storing the accumulated illumination time; and means for correcting the image signal in accordance with the accumulated illumination time stored, in which the corrected image signal is used to display the image.

According to another aspect of the present invention, a passive matrix light emitting device receiving an image signal as an input to display an image, includes:

means for detecting an accumulated illumination time and an illumination intensity in each pixel from the image signal inputted;

means for storing the accumulated illumination time and the illumination intensity; and means for correcting the image signal in accordance with the accumulated illumination time and the illumination intensity which are stored, in which the corrected image signal is used to display the image.

According to another aspect of the present invention, a passive matrix light emitting device receiving an image signal as an input to display an image, includes:

a degradation correction device including:

detection means having a counter unit that samples a first image signal inputted and periodically detects an illumination time of a self-luminous element in each pixel;

storage means having a storage circuit unit that accumulates the illumination time of the self-luminous element in each pixel detected by the counter unit and stores the accumulated illumination time; and correction means having a signal correction unit that corrects the first image signal in accordance with the accumulated illumination time of the self-luminous element in each pixel stored in the storage circuit unit and outputs a second image signal; and a display device that displays an image based on the second image signal.

According to another aspect of the present invention, a passive matrix light emitting device receiving an image signal as an input to display an image, includes:

a degradation correction device including:

detection means having a counter unit that samples a first image signal inputted and periodically detects an illumination time and illumination intensity of a self-luminous element in each pixel;

storage means having a storage circuit unit that accumulates the illumination time and illumination intensity of the self-luminous element in each pixel detected by the counter unit and stores the accumulated illumination time and illumination intensity; and correction means having a signal correction unit that corrects the first image signal in accordance with the accumulated illumination time and illumination intensity of the self-luminous element in each pixel stored in the storage circuit unit and outputs a second image signal; and a display device that displays the image based on the second image signal.

In a further aspect of the passive matrix light emitting device of the present invention, when the light emitting device performs an n-bit (n is a natural number, $n \geqq 2$) gray scale display, the light emitting device further includes a driver circuit that performs an (n+m)-bit (m is a natural number) signal processing; and an image signal that is to be written into a pixel having a non-degraded self-luminous element is an n-bit image signal used to perform a gray scale display, and an image signal that is to be written into a pixel having a degraded self-luminous element is subjected to a gray scale addition processing by using an m-bit signal to thereby make a brightness of the non-degraded self-luminous element and a brightness of the degraded self-luminous element equal to each other.

In a further aspect of the passive matrix light emitting device of the present invention, the correction means performs an addition processing to an image signal that is to be written into a pixel having a degraded self-luminous element relatively to an image signal that is to be written into a pixel having a non-degraded self-luminous element.

In a further aspect of the passive matrix light emitting device of the present invention, the correction means performs, within a display range, a subtraction processing to an image signal that is to be written into a pixel having a slightly degraded self-luminous element or a non-degraded self-luminous element relatively to an image signal that is to be written into a pixel having a most degraded self-luminous element.

According to another aspect of the present invention, a passive matrix light emitting device receiving an image signal as an input to display an image, includes:

means for detecting an accumulated illumination time in each pixel from the image signal inputted;

means for storing the accumulated illumination time; and means for correcting the image signal in accordance with the accumulated illumination time stored, in which the corrected image signal is converted into an analog image signal, and the analog image signal is used to display the image.

According to another aspect of the present invention, a passive matrix light emitting device receiving an image signal as an input to display an image, includes:

means for detecting an accumulated illumination time and an illumination intensity in each pixel from the image signal inputted;

means for storing the accumulated illumination time and the illumination intensity; and means for correcting the image signal in accordance with the accumulated illumination time and the illumination intensity which are stored, in which the corrected image signal is converted into an analog image signal, and the analog image signal is used to display the image.

According to another aspect of the present invention, a passive matrix light emitting device receiving an image signal as an input to display an image, includes:

a degradation correction device including:

detection means having a counter unit that samples a first image signal inputted and periodically detects an illumination time of a light emitting element in each pixel;

storage means having a storage circuit unit that accumulates the illumination time of the light emitting element in each pixel detected by the counter unit and stores the accumulated illumination time; and correction means having a signal correction unit that corrects the first image signal in accordance with the accumulated illumination time of the light emitting element in each pixel stored in the storage circuit unit and outputs a second image signal; and a display device that converts the second image signal into an analog image signal and displays the image based on the analog image signal.

According to another aspect of the present invention, a passive matrix light emitting device receiving an image signal as an input to display an image, includes:

a degradation correction device including:

detection means having a counter unit that samples a first image signal inputted and periodically detects an illumination time and illumination intensity of a light emitting element in each pixel;

storage means having a storage circuit unit that accumulates the illumination time and illumination intensity of the light emitting element in each pixel detected by the counter unit and stores the accumulated illumination time and illumination intensity; and correction means having a signal correction unit that corrects the first image signal in accordance with the accumulated illumination time and the illumination intensity of the light emitting element in each pixel which are stored in the storage circuit unit and outputs a second image signal; and a display device that converts the second image signal into an analog image signal and displays the image based on the analog image signal.

In a further aspect of the passive matrix light emitting device of the present invention, it is possible that when the light emitting device performs an n-bit (n is a natural number, $n \geqq 2$) gray scale display, the light emitting device further includes a driver circuit that performs an (n+m)-bit (m is a natural number) signal processing; and an image signal that is to be written into a pixel having a non-degraded light emitting element is an n-bit image signal used to perform a gray scale display, and an image signal that is to be written into a pixel having a degraded light emitting element is subjected to a gray scale addition processing by using an m-bit signal to thereby make a brightness of the non-degraded light emitting element and a brightness of the degraded light emitting element equal to each other.

In a further aspect of the passive matrix light emitting device of the present invention, it is possible that an image signal that is to be written into a pixel having a degraded light emitting element is obtained in the correction means by undergoing an addition processing relatively to an image signal that is to be written into a pixel having a non-degraded light emitting element.

In a further aspect of the passive matrix light emitting device of the present invention, it is possible that, within a display range, an image signal that is to be written into a pixel having a slightly degraded light emitting element or a non-degraded light emitting element is obtained in the correction means by undergoing a subtraction processing relatively to an image signal that is to be written into a pixel having a most degraded light emitting element.

In a further aspect of the passive matrix light emitting device of the present invention, the storage means has a static random access memory (SRAM).

In a further aspect of the passive matrix light emitting device of the present invention, the storage means has a dynamic random access memory (DRAM).

In a further aspect of the passive matrix light emitting device, the storage means has a ferroelectric random access memory (FRAM).

In a further aspect of the passive matrix light emitting device of the present invention, the detection means, the storage means, and the correction means are structured by an external circuit that is formed outside the passive matrix light emitting device.

In a further aspect of the passive matrix light emitting device of the present invention, the detection means, the storage means, and the correction means are mounted on an identical insulator on which the passive matrix light emitting device is mounted.

In a further aspect of the passive matrix light emitting device of the present invention, the passive matrix light emitting device is a passive matrix EL display.

According to another aspect of the present invention, there is provided an electronic equipment using the passive matrix light emitting device of the present invention.

It should be noted here that any method of gray scale display can be used when carrying out the present invention. That is, the present invention can be implemented by digital gray scale display and analog gray scale display.

DETAILED DESCRIPTION OF THE PREFERRED EMBODIMENTS

Embodiment Mode 1

Figure 1:
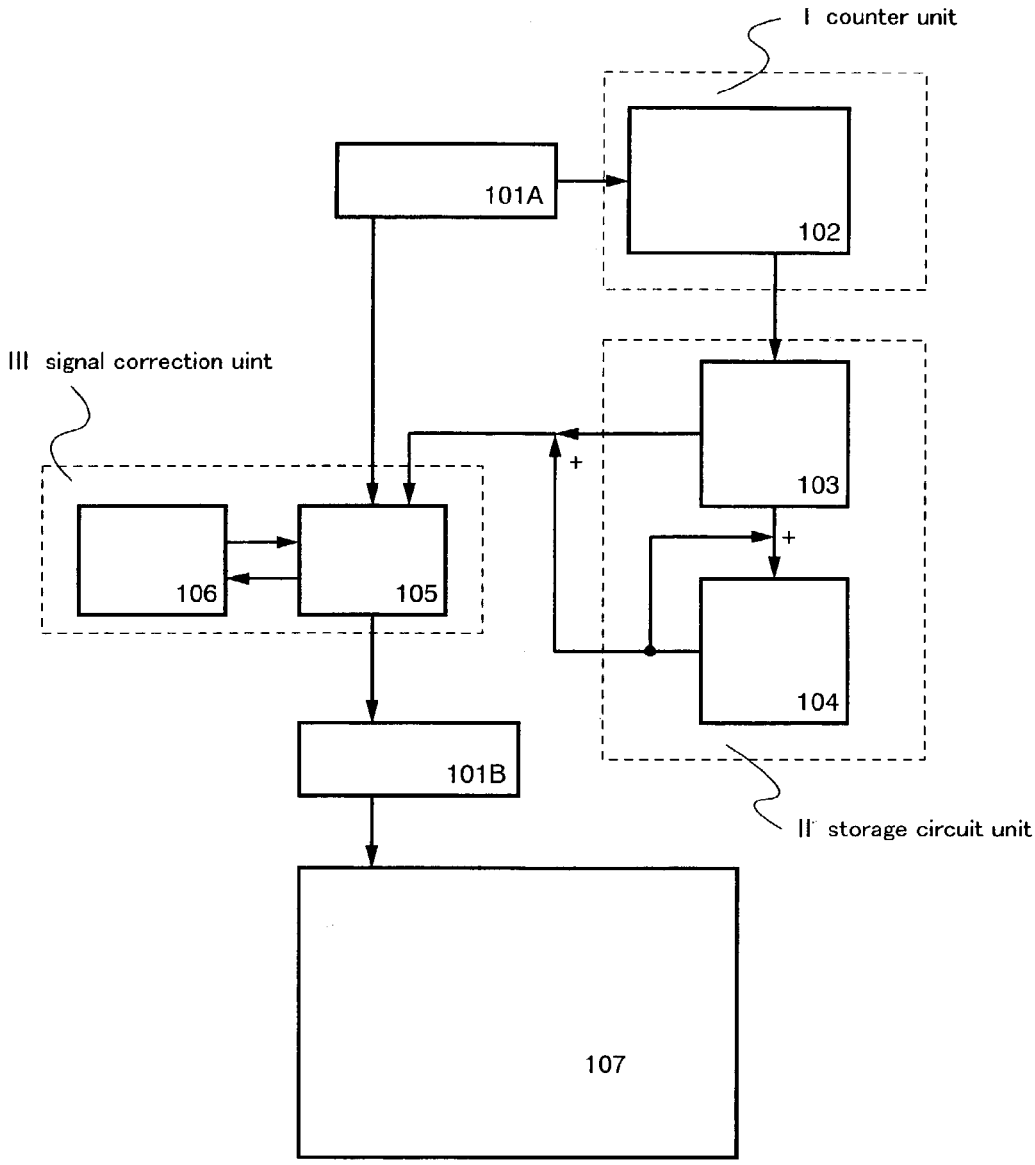
FIG. 1 is a block diagram of a light emitting device having a degradation correction function of the present invention (in a case of digital gray scale display)

Embodiment modes of the present invention will be described below with reference to the figures. First, referring to FIG. 1, a case of digital gray scale display is explained as an example. FIG. 1 is a block diagram of a light emitting device having a degradation correction function of the present invention. The light emitting device having a degradation correction function of the present invention includes a counter unit (I), a storage circuit unit (II), a signal correction unit (III), and a display device 107. A degradation correction device which is an essential part of the present invention is composed of the counter unit (I), the storage circuit unit (II), and the signal correction unit (III). The counter unit (I) has a counter 102, the storage circuit unit (II) has a volatile memory 103 and a non-volatile memory 104, and the signal correction unit (III) has a correction circuit 105 and a correction data storage unit 106.

Figure 8:
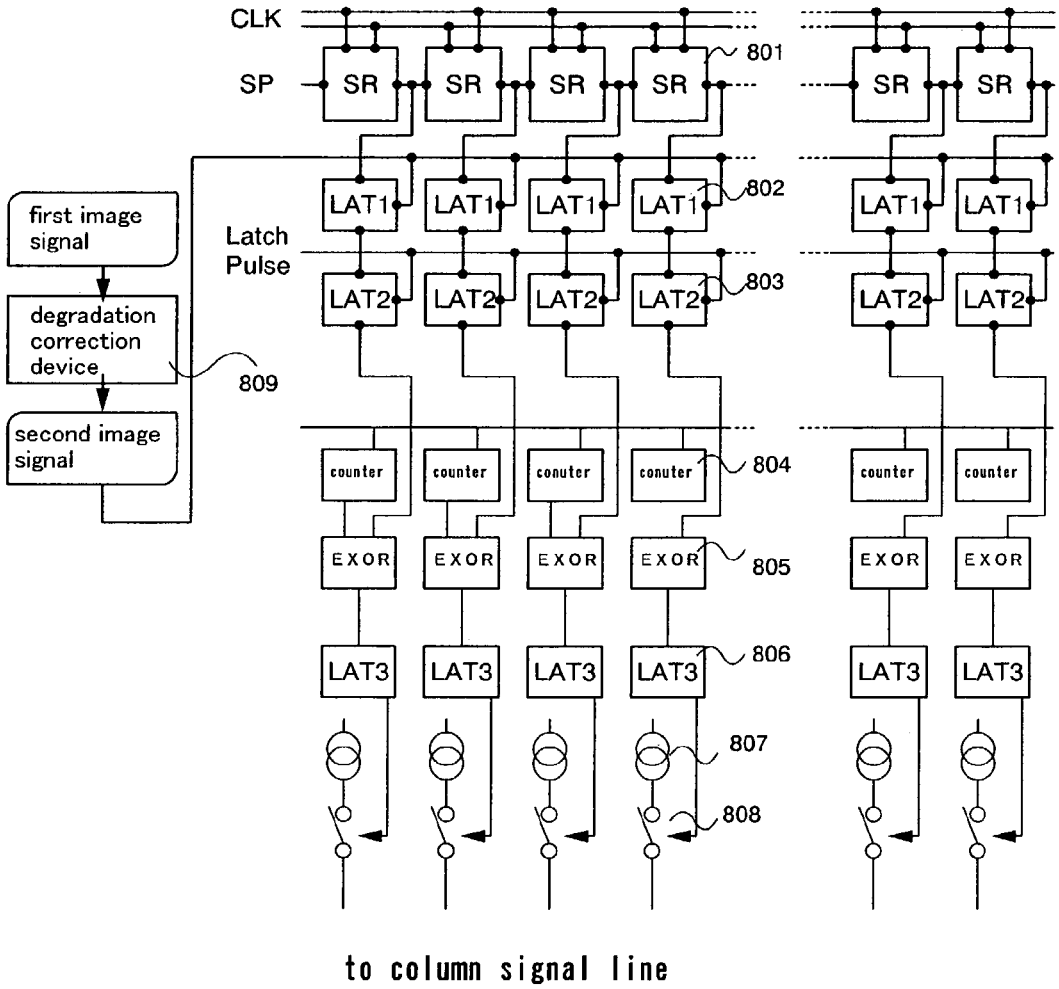
FIG. 8 is a diagram illustrative of a column signal line driver circuit (in a case of digital gray scale display)

A circuit diagram of a column signal line driver circuit in the display device 107 is shown in FIG. 8. In this example here, a display device corresponding to a digital image signal is used. The column signal line driver circuit includes shift registers (SRs) 801, first latch circuits (LAT1s) 802, second latch circuits (LAT2s) 803, counters 804, exclusive OR gates (EXORs) 805, third latch circuits (LAT3s) 806, constant current sources 807, switches 808, and the like. Reference numeral 809 denotes the degradation correction device shown in FIG. 1.

An explanation is given to the operation of each part. In accordance with a clock signal (CLK) and a start pulse (SP), the shift registers sequentially output sampling pulses. The first latch circuit retains the digital image signal at a timing of the corresponding sampling pulse. As shown in FIG. 8, the image signal has already been corrected at this time point, and thus changed into a second image signal. In the first latch circuit, when completing retention of signals for one horizontal period, a latch pulse is outputted, so that transfer of the digital image signal to the second latch circuit is conducted. After that, the output of the second latch circuit and the output of the counter 804 are compared at the EXOR 805. A clock signal is inputted to the counter 804, and the count result is inputted to the EXOR 805. In a case where the output of the counter 804 and the output of the second latch circuit 803 are identical to each other, the output of the EXOR 805 is changed, and then latched in the third latch circuit 806. The switch 808 is controlled by the output of the third latch circuit to be turned ON or OFF. Similarly, for the next line, in accordance with a sampling pulse from the shift register, retention of a digital image signal is conducted in the first latch circuit. In this manner, the respective ON time periods for the switches 808 are determined according to the second image signals, so that gray scale display is made possible.

Next, the operation of the entire degradation correction device is explained. First, as to a light emitting element used in the light emitting device, data on change of brightness characteristics thereof with time is stored in advance in the correction data storage unit 106. This data, which will be described later, is mainly used as a map for correcting a signal in accordance with a degradation degree of a light emitting element in each pixel.

Subsequently, a first image signal 101A is periodically sampled (for example, every one second). With the signal, the number of times for illumination or no illumination in each pixel is counted by a counter 102. Then, the counted number of times for illumination in each pixel is sequentially stored in the storage circuit unit. Here, since the number of times for illumination is accumulated, it is desirable that the storage circuit be composed of a non-volatile memory. However, non-volatile memories are usually limited in the number of times for the writing operation. Therefore, as shown in FIG. 1, it may be structured such that storage is conducted using the volatile memory 103 during the operation of the light emitting device, and writing is conducted to the non-volatile memory 104 at regular intervals (for example, every one hour, or at the time of shutdown).

In a case where gray scale representation using light emitting elements is performed under brightness control too, an illumination intensity of each light emitting element at this time is detected along with an illumination time. The degradation state of the respective light emitting elements may accordingly be judged based on both the illumination time and the illumination intensity. In this case, the correction data is generated in accordance with the detected illumination time and illumination intensity.

As a volatile memory, there are a static random access memory (SRAM), a dynamic random access memory (DRAM), a ferroelectric random access memory (FRAM) and the like. However, the present invention is not limited to these, and may be implemented using a memory of any type. Similarly, a non-volatile memory may be structured with a general-use memory represented by a flash memory. It should be noted here that it is necessary to newly provide a periodical refresh function in a case where the DRAM is used for the volatile memory.

Next, a description on the correction operation of an image signal is given. The first image signal 101A and data of the accumulated illumination time or data of the accumulated illumination time and illumination intensity in each pixel are inputted in the correction circuit 105. The correction circuit 105 refers to the map for the image signal correction stored in advance in the correction data storage unit 106 and data of the accumulated illumination time or data of the accumulated illumination time and illumination intensity in each pixel to conduct correction on the inputted image signal in accordance with the degradation degree in each pixel. A second image signal 101B corrected in this way is inputted to the display device 107 to display an image.

When the power source is shut off, the accumulated illumination time or the accumulated illumination time and illumination intensity thereof, which is stored in a volatile storage circuit, is added to the accumulated illumination time or the accumulated illumination time and illumination intensity stored in a non-volatile storage circuit to be stored. Accordingly, accumulating count of the accumulated illumination time of the light emitting element or the accumulated illumination time and illumination intensity thereof is conducted in a continuous manner when the power source is turned ON next time.

As described above, the illumination time of the light emitting element is regularly detected, and the accumulated illumination time or the accumulated illumination time and illumination intensity is stored. As a result, correction can be conducted to the image signal such that the brightness of a degraded light emitting element is made substantially equal to the brightness of a non-degraded light emitting element with time by referring to the data stored in advance concerning a change of brightness characteristics of the light emitting element to correct the image signal as occasion demands. Thus, the uniformity across the screen can be achieved without the occurrence of brightness variance.

Embodiment Mode 2

While as an embodiment mode of the present invention, a case of digital gray scale display is described in Embodiment Mode 1, as an embodiment mode of the present invention, a case of analog gray scale display is described in Embodiment Mode 2.

Figure 13:
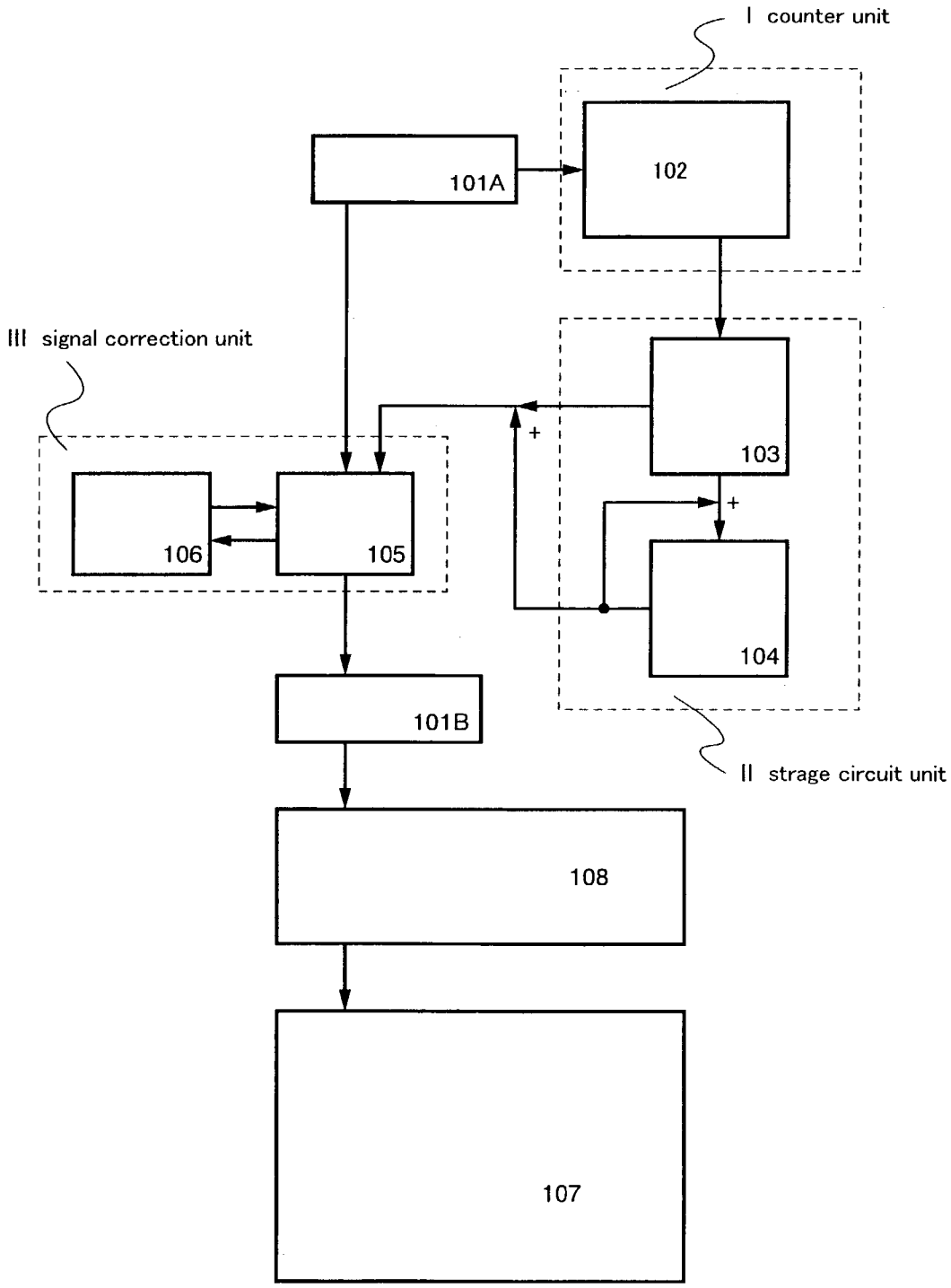
FIG. 13 is a block diagram of a light emitting device having a degradation correction function of the present invention (in a case of analog gray scale display)
Figure 14:
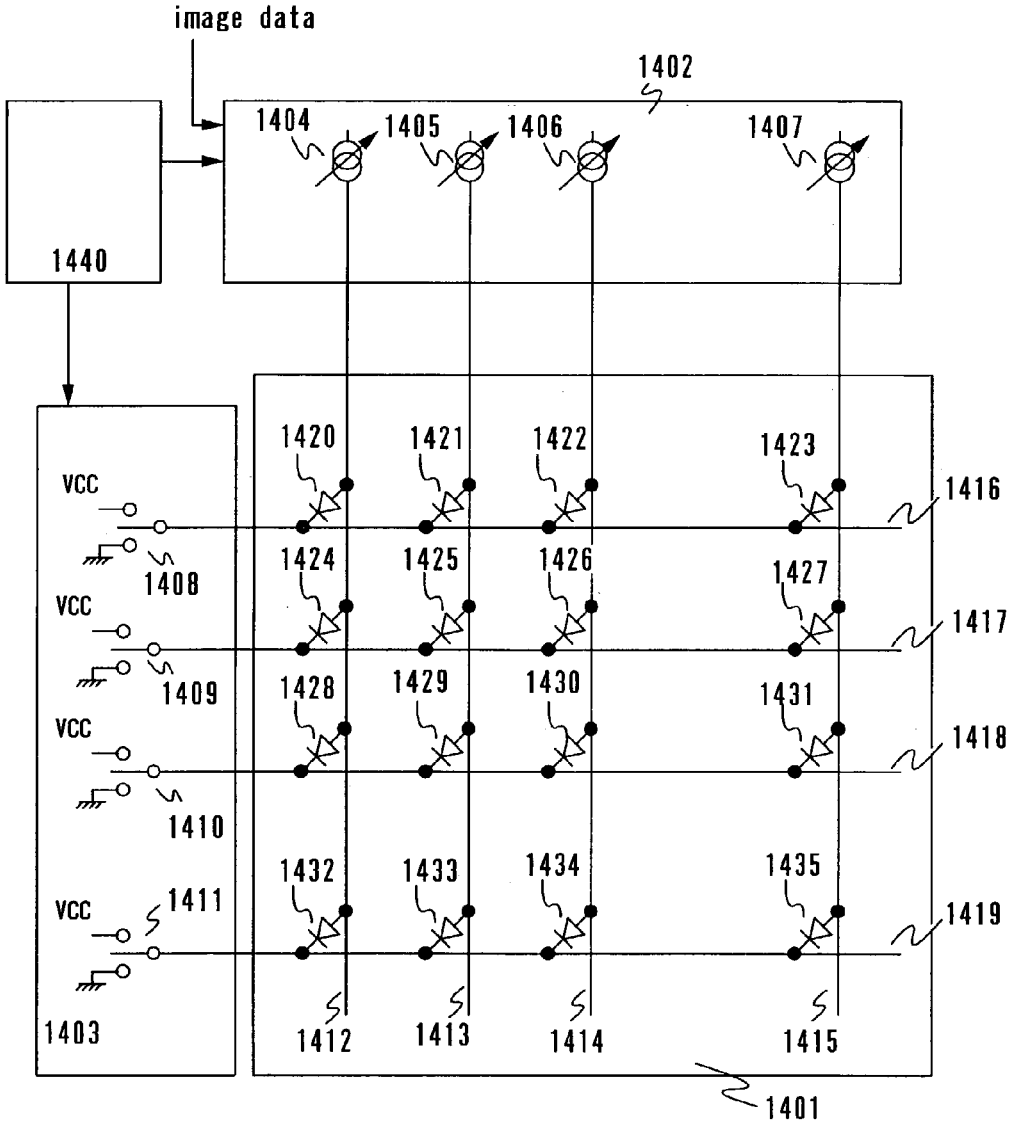
FIG. 14 is a diagram illustrative of a conventional passive matrix light emitting device (in a case of analog gray scale display)
Figure 15:
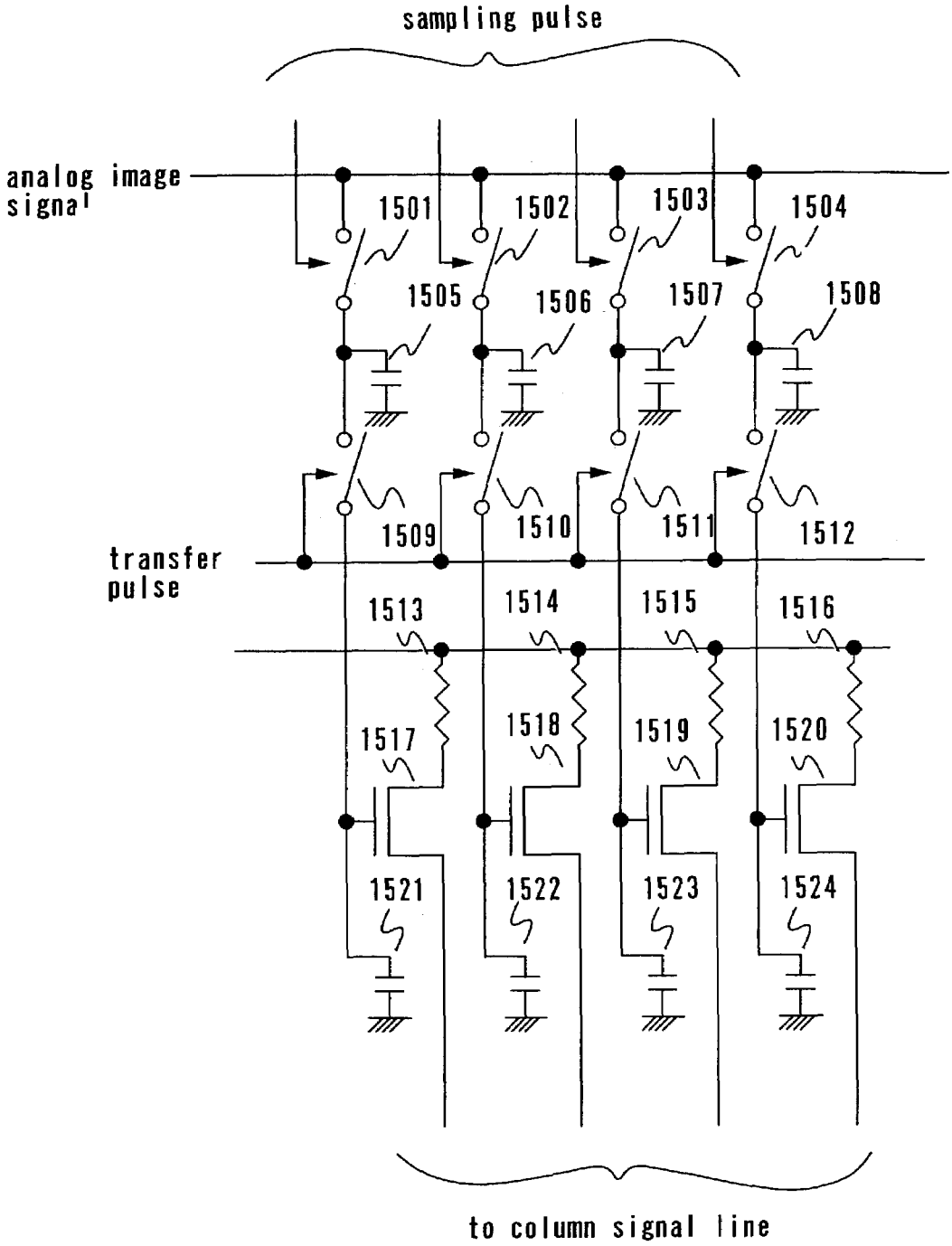
FIG. 15 is a diagram illustrative of a column signal line driver circuit of the conventional passive matrix light emitting device (in a case of analog gray scale display)

FIG. 13 is a block diagram of a light emitting device having a degradation correction function of the present invention in a case of analog gray scale display. The light emitting device having a degradation correction function of the present invention includes a counter unit (I), a storage circuit unit (II), a signal correction unit (III), a DA converter 108, and a display device 107. A degradation correction device which is an essential part of the present invention is composed of the counter unit (I), the storage circuit unit (II), and the signal correction unit (III). The counter unit (I) has a counter 102, the storage circuit unit (II) has a volatile memory 103 and a non-volatile memory 104, and the signal correction unit (III) has a correction circuit 105 and a correction data storage unit 106.

Figure 16:
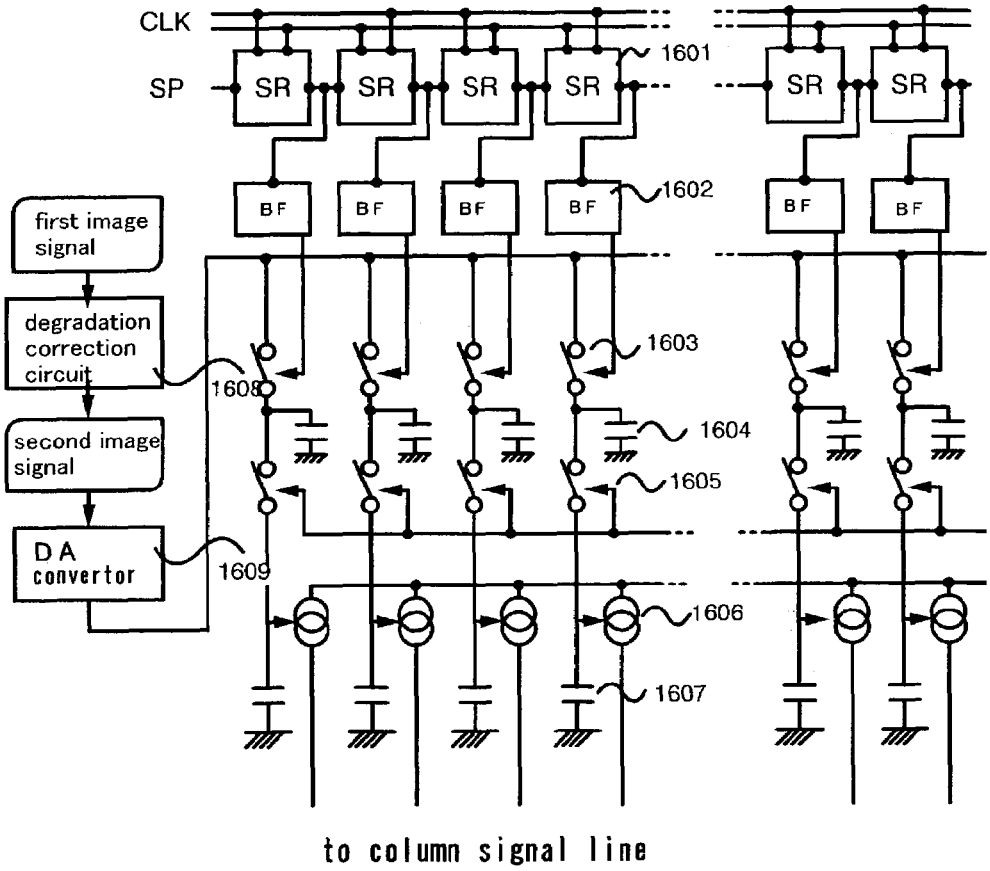
FIG. 16 is a diagram illustrative of a column signal line driver circuit (in a case of analog gray scale display).

A circuit diagram of a column signal line driver circuit in the display device 107 is shown in FIG. 16. In this example here, a display device corresponding to an analog image signal is used. The column signal line driver circuit includes shift registers (SRs) 1601, buffer circuits 1602, sampling switches 1603, analog memories 1604, transfer switches 1605, variable current sources 1606, analog memories 1607, and the like. Reference numeral 1608 denotes the degradation correction device shown in FIG. 1, and numeral 1609 denotes a DA converter.

An explanation is given to the operation of each part. In accordance with a clock signal (CLK) and a start pulse (SP), the shift registers sequentially output sampling pulses via the buffer circuits 1602. The sampling switch 1603 samples the analog image signal at a timing of the corresponding sampling pulse. As shown in FIG. 16, the image signal has already been corrected at this time point, and thus changed into a second image signal, so that the signal has been converted into the analog signal in the DA converter 1609. In the analog memory 1604, when completing retention of signals for one horizontal period, a transfer pulse is outputted, and transfer of the analog image signal to the analog memory 1607 is then conducted. After that, the analog voltage is inputted to the variable current source 1606 to be converted into a current. The current is then outputted to the corresponding column signal line. Similarly, for the next line, in accordance with a sampling pulse from the shift register, retention of an analog image signal is conducted in the analog memory. In this manner, the current is set in accordance with the second image signal, so that gray scale display is made possible.

The operation of the entire degradation correction device is the same as that in a case of digital gray scale display, and an explanation thereof is thus omitted here. Further, except that the second image signal 101B is converted into an analog signal in the DA converter 108 before being inputted to the display device 107, the operation for correcting an image signal is the same as that in a case of digital gray scale display, and an explanation thereof is thus omitted here.

As described above, the illumination time of the light emitting element is regularly detected, and the accumulated illumination time or the accumulated illumination time and illumination intensity is stored. As a result, correction can be conducted to the image signal such that the brightness of a degraded light emitting element is made substantially equal to the brightness of a non-degraded light emitting element by making reference to the data stored in advance concerning a change of brightness characteristics with time of the light emitting element to correct the image signal as occasion demands. Thus, the uniformity across the screen can be achieved without the occurrence of brightness variance.

EMBODIMENTS

Hereinafter, embodiments of the present invention are described. In Embodiments 1 through 5 below, a light emitting device of the present invention for performing digital gray scale display is mainly described as an example. However, the present invention is not limited to the case of digital gray scale display, but can also be applied to the case of analog gray scale display.

Embodiment 1

In this embodiment, a method of correcting a digital image signal in a signal correction unit is explained.

As an example of a method of compensating the brightness of a degraded light emitting element at a signal level, there is one in which a certain correction value is added to a digital image signal to be inputted, and the signal is converted into a signal which substantially has a gray scale higher than the original one by several ranks, so that the brightness substantially equal to the brightness before the degradation can be achieved. To realize this with a circuit design in the simplest way, a circuit with which a gray scale addition processing can be conducted may be provided in advance. To be specific, in a case of a light emitting device specific for 6-bit digital gray scale (64 gray scales) having a degradation correction function of the present invention, for example, a processing ability for 1-bit as an add-on for conducting correction is newly provided to the light emitting device to thereby design and manufacture a light emitting device substantially specific for 7-bit digital gray scale (128 gray scales). In such a light emitting device, lower 6 bits are used in the normal operation, and if an EL element is degraded, a correction value is added to a normal digital image signal by using the above-mentioned add-on 1 bit for the addition processing in the signal processing. In this case, the most significant bit (MSB) is only used for the signal correction, and actual display is performed with 6-bit gray scale.

Embodiment 2

In this embodiment, a correction method for a digital image signal different from that in Embodiment 1 will be described. Here, a case of digital gray scale display is described using FIG. 1 as an example, but the present invention should not be limited thereto. The light emitting device (FIG. 1) of the present invention performing digital gray scale display and the light emitting device (FIG. 13) of the present invention performing analog gray scale display both have the same structure of the degradation correction device which is an essential part of the present invention (being composed of the counter unit (I), the storage circuit unit (II), and the signal correction unit (III)). Thus, the correction for a digital image signal can be conducted similarly in a case of analog time gray scale display.

Figure 2A:
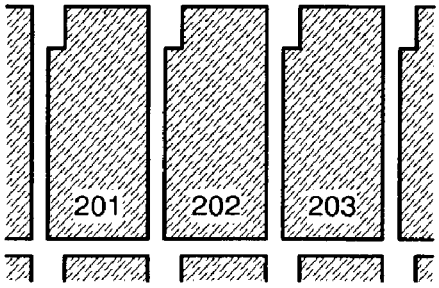
FIGS. 2A to 2E are diagrams showing a correcting method with addition processing.
Figure 2B:
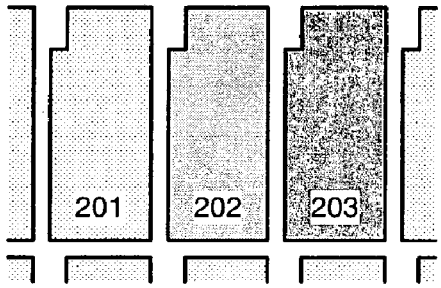

FIGS. 1 and 2A to 2E are referred to. FIG. 2A shows a portion of pixels of the display device 107 in FIG. 1. Here, three pixels 201 to 203 are considered. First, the pixel 201 is a non-degraded pixel, and the pixels 202 and 203 are respectively degraded to a certain extent. At this time, if the degradation level of the pixel 202 is larger than that of the pixel 203, the decrease in brightness of the pixel 202 due to the degradation is of course larger. That is, when a half tone is displayed, the brightness variance occurs as shown in FIG. 2B. With respect to the brightness of the pixel 201, the brightness of the pixel 202 is low, and the brightness of the pixel 203 is still lower.

Figure 2C:
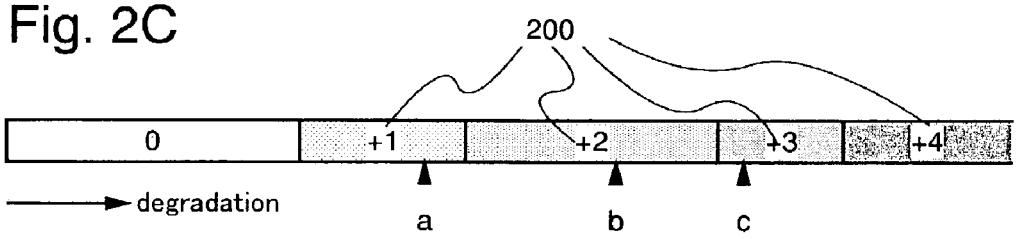

Next, the actual correction operation is explained. A relationship between an illumination time of a light emitting element or an illumination time and illumination intensity thereof and the brightness decrease along with the degradation is measured in advance. A map in which a correction amount is set with respect to an accumulated illumination time is prepared to be stored in the correction data storage unit 106. An example thereof is shown in FIG. 2C. Respective numbers in blocks denoted by reference numeral 200 correspond to digital image signal correction amounts. That is, a digital image signal to be inputted into a pixel in which the light emitting device degradation accumulates to a stage "a" is always added with 1. Thus, the image signal is converted into a signal with the brightness higher by one gray scale. Similarly, two gray scales in a stage "b", and three gray scales in a stage "c" are added for the signal correction. The decrease in brightness and the accumulated illumination time or the accumulated illumination time and illumination intensity are not necessarily in direct proportion. Therefore, the correction widths of the image signal are set approximate in steps by one gray scale.

Figure 2D:
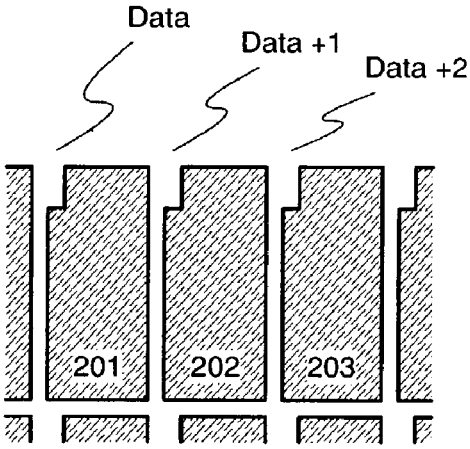
Figure 2E:
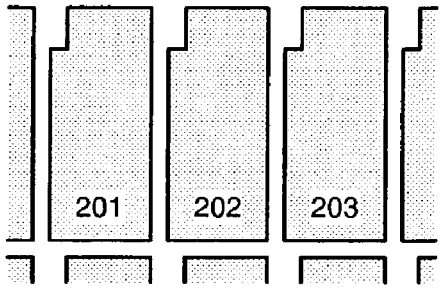

In FIG. 1, inputting of the digital image signal (first image signal) 101A and reading of the accumulated illumination time in each pixel stored in the storage circuit unit are conducted in the correction circuit 105. The accumulated illumination time or the accumulated illumination time and illumination intensity read in each pixel is compared with the above-mentioned correction map to determine the correction value for each digital image signal. FIG. 2A is now used to give a specific explanation. Based on the accumulated illumination time or the accumulated illumination time and illumination intensity, the pixel 201 is judged as not being degraded, and the image signal correction is not conducted thereto. In FIG. 2B, if the pixel 202 is judged as being degraded up to the stage "a", a digital image signal to instruct the pixel 202 to emit light is subjected to the correction with addition processing for +1 gray scale, as shown in FIG. 2D. In the same manner, if the pixel 203 is judged as being degraded up to the stage "b", a digital image signal to instruct the pixel 203 to emit light is subjected to the correction with addition processing for +2 gray scales. As described above, the correction with addition processing is conducted, and as a result, it becomes possible to obtain a uniform brightness screen, as shown in FIG. 2E.

Figure 3A:
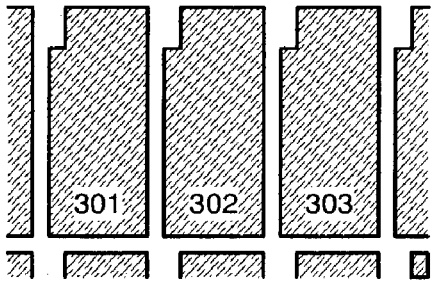
FIGS. 3A to 3E are diagrams showing a correcting method with subtraction processing.
Figure 3B:
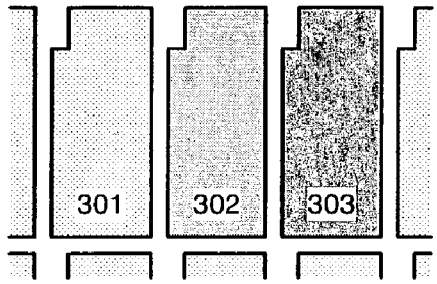

Subsequently, the correction method with subtraction processing is described with reference to FIGS. 1 and 3A to 3C. Since FIGS. 3A to 3C are similar to FIGS. 2A to 2C, an explanation thereof is omitted here.

Figure 3C:
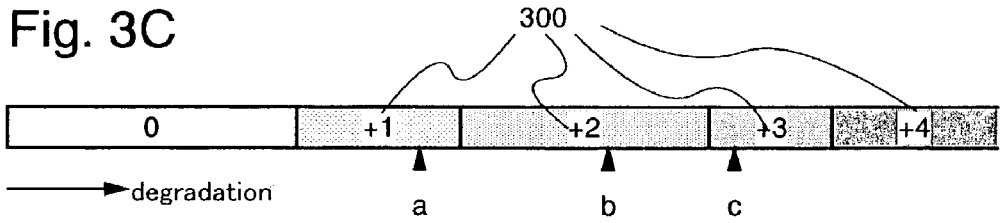
Figure 3D:
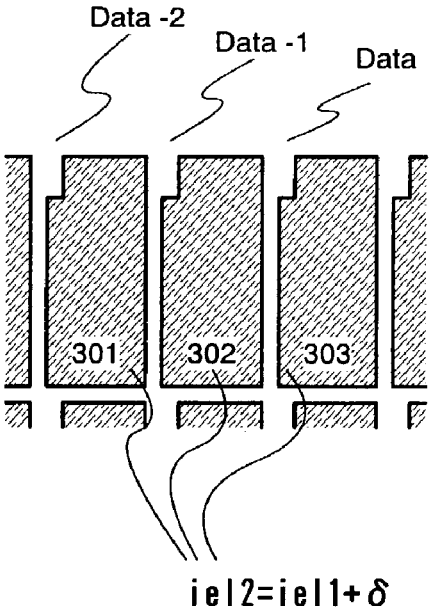
Figure 3E:
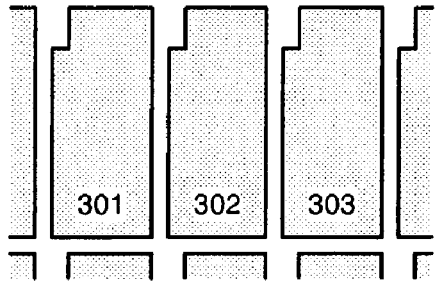

The accumulated illumination time or the accumulated illumination time and illumination intensity in each pixel is compared with the map in which the correction amount is set shown in FIG. 3C to determine the correction value for each digital image signal. At this time, a pixel serving as a reference, namely a pixel to which an original digital image signal without being corrected is directly inputted, corresponds to a pixel judged as being most degraded based on the accumulated illumination time or the accumulated illumination time and illumination intensity. To be specific, such a pixel corresponds to a pixel 303 shown in FIG. 3B. Setting the pixel as a reference, digital image signals to be inputted to other pixels are respectively corrected in accordance with the degradation degree. As shown in FIG. 3D, the original digital image signal is inputted to the most degraded pixel 303 (assumed to be degraded up to a stage "b" in FIG. 3C). A digital image signal being corrected with the subtraction processing for −1 gray scale is inputted to a pixel 302 whose degradation level is lower than the pixel 303 by one level (assumed to be degraded up to a stage "a" in FIG. 3C). Further, a digital image signal being corrected with the subtraction processing for −2 gray scales is inputted to a pixel 301 that is judged as not degraded based on the accumulated illumination time or the accumulated illumination time and illumination intensity.

Figure 9:
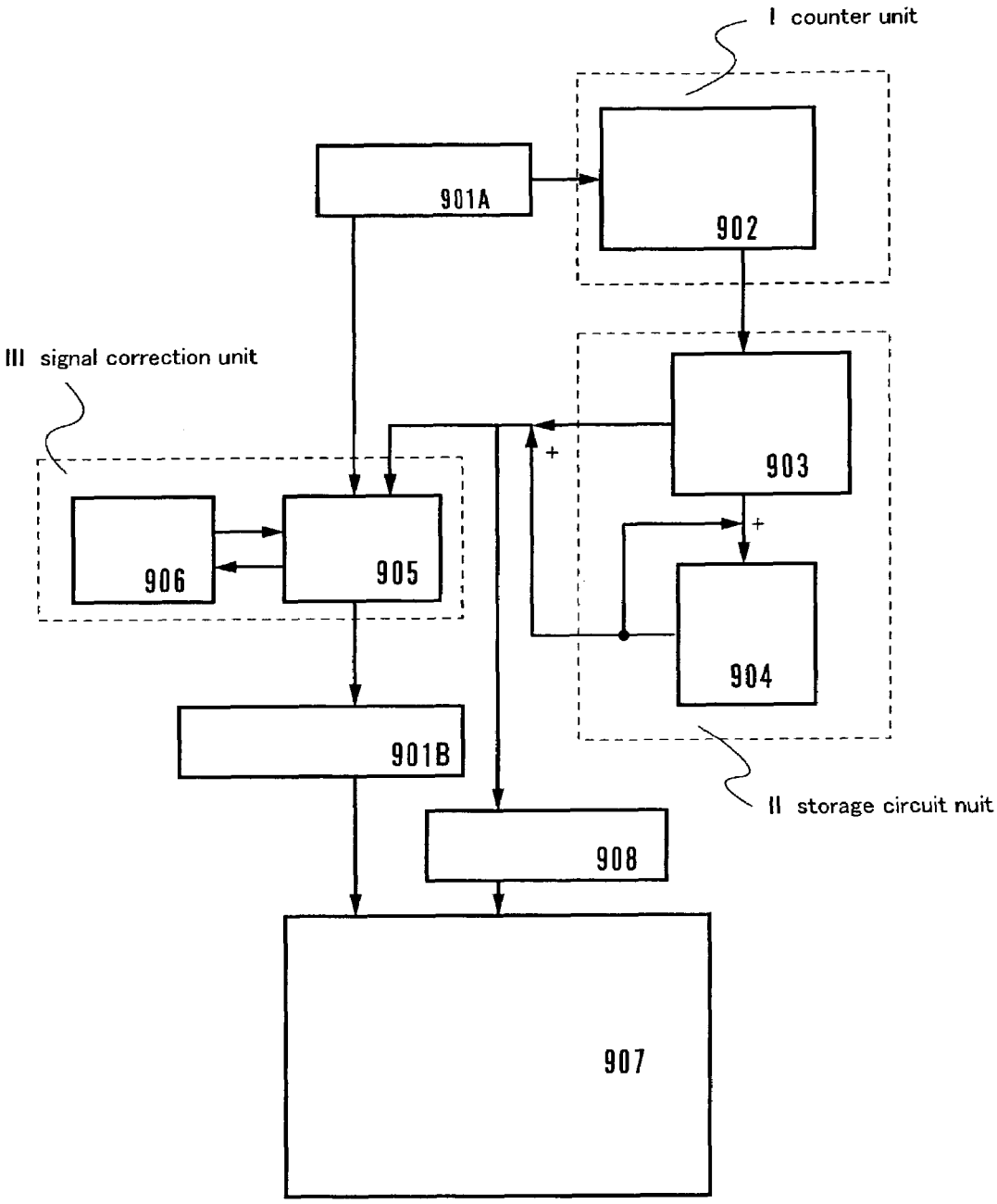
FIG. 9 is a diagram illustrative of the light emitting device having a degradation correction function of the present invention.
Figure 10A:
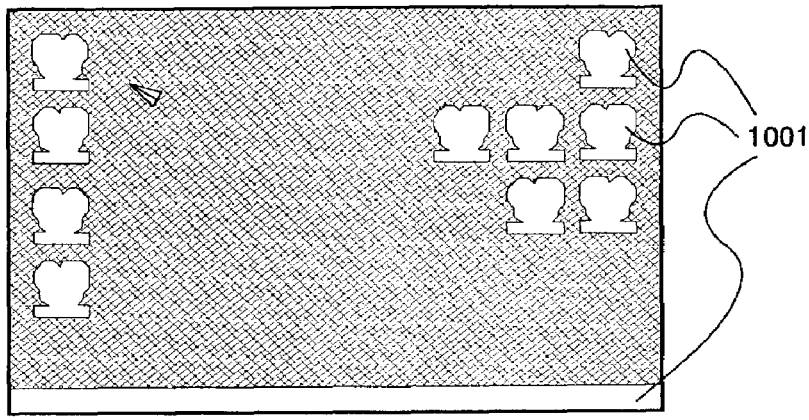
FIGS. 10A to 10C are diagrams showing an occurrence of brightness variance in a screen due to the degradation of a light emitting element.
Figure 10B:
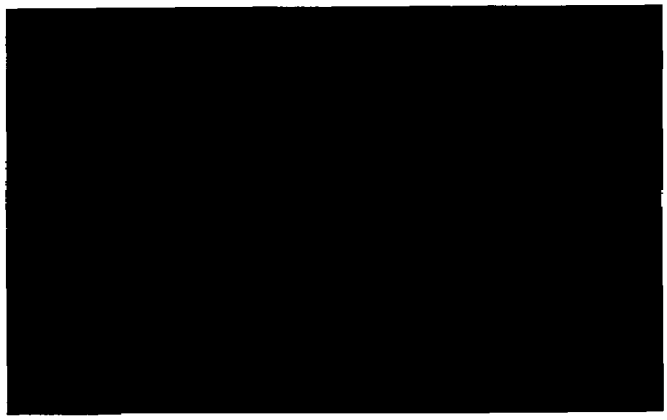
Figure 10C:
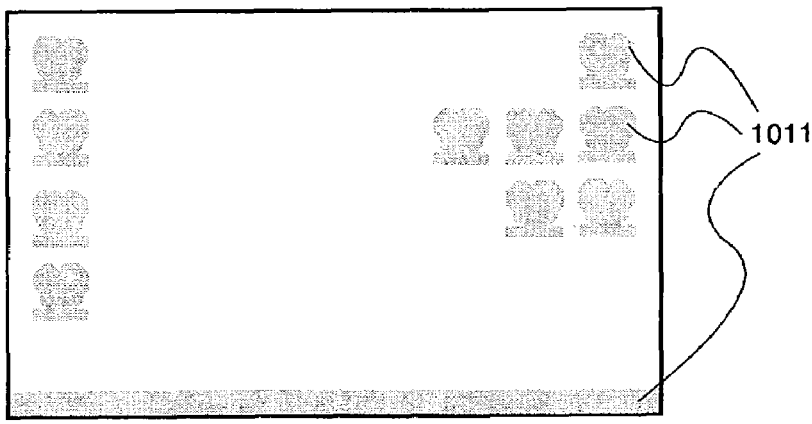

However, if the correction is conducted based on the above-mentioned method, the brightness across the entire screen is lowered by several gray scales (corresponding to the difference between the gray scale represented by the original digital image signal and the gray scale represented by the second image signal to be written into a pixel having a non-degraded light emitting element). Therefore, at the same time, as shown in FIG. 3D, a current flowing in each column signal line is changed to slightly increase a current $i_{EL}$ ($i_{EL}$+ä $i_{EL2}$) of the light emitting element, thereby compensating the brightness of the entire screen. This can be achieved by a structure in which a constant current in the column signal line driver circuit is controlled in accordance with the accumulated illumination time as shown in FIG. 9.

In the former correction case with the addition processing, the brightness variance can be corrected only by the digital image signal processing, but there is a defect in which the correction in the white display cannot be conducted. In specific, when "111111" is inputted as a 6-bit digital image signal, no further addition processing is possible. In the latter correction case with the subtraction processing, potential control of the current supply line for the brightness compensation is added but, on the contrary to the correction with addition processing, an area where correction cannot be performed corresponds to an area of the black display, so that there is a feature in which an influence is hardly seen. In specific, when "000000" is inputted as a 6-bit digital image signal, no further subtraction processing is necessary, so that it is possible to perform the accurate black display among the normal light emitting elements and degraded light emitting elements (those light emitting elements may simply be left in no illumination state, in addition, several gray scales close to black do not lead to a serious problem if the corresponding number of bits of the display device is somewhat large). As described above, the correction methods are both effective in increasing the number of gray scales.

Further, it can be mentioned that, while setting a gray scale as a boundary, a correction method is effective which utilizes both the correction method with addition processing and the correction method with subtraction processing to eliminate disadvantages of those correction methods.

Embodiment 3

In the passive matrix light emitting device having the degradation correction function of the present invention, according to an example of the light emitting device (FIG. 1) of the present invention performing digital gray scale display described in Embodiment Modes 1 and 2, the degradation correction device is disposed outside the display device 107, and the digital image signal (first image signal) 101A is first inputted to the correction circuit 105 to be corrected immediately. The corrected digital image signal (second image signal) 101B is inputted to the display device 107 via the FPC. Advantages of such a method include a compatibility obtained by structuring the degradation correction device into units (a conventional light emitting device can be used for the display device 107 as it is). On the other hand, if the degradation correction device and the display device are mounted on the same substrate, space-saving and high-speed driving can be realized.

Figure 4A:
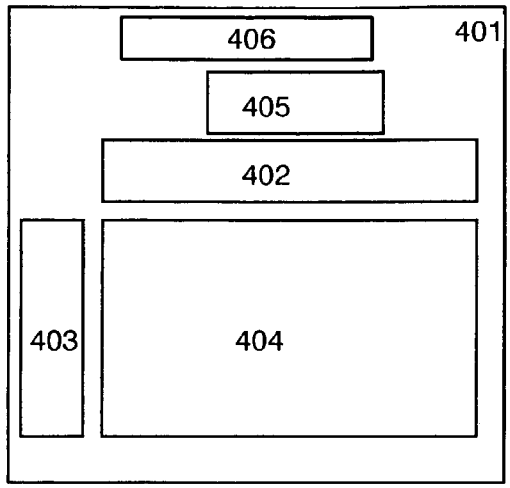
FIGS. 4A to 4C are block diagrams showing an example of a light emitting device in a case where a signal correction device is mounted on a display device substrate.
Figure 4B:
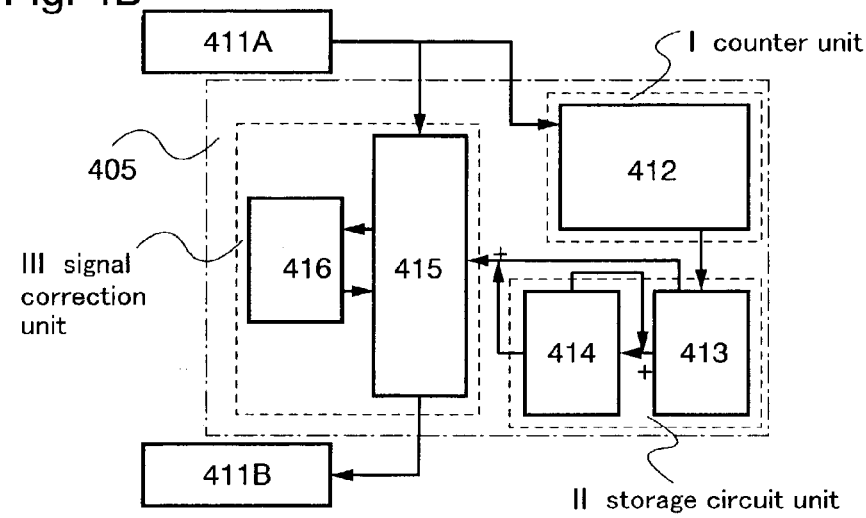
Figure 4C:
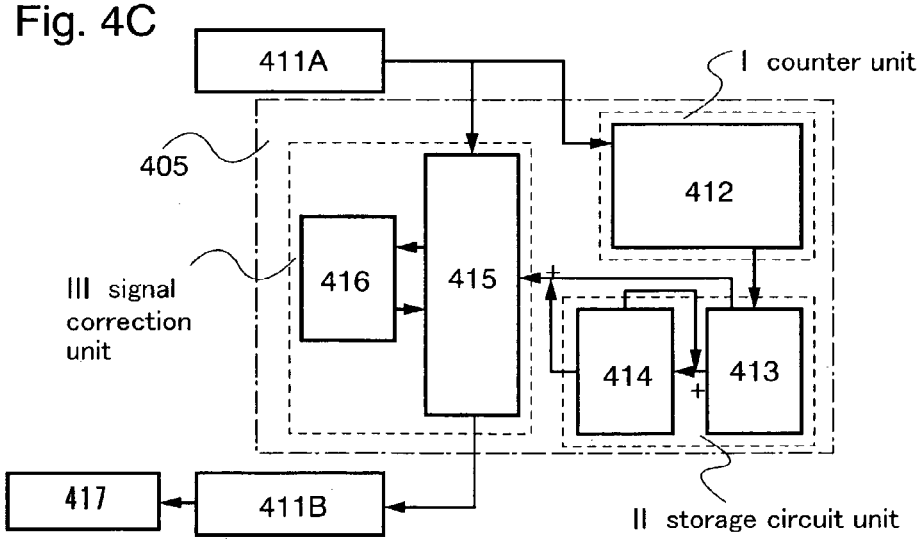
Figure 5:
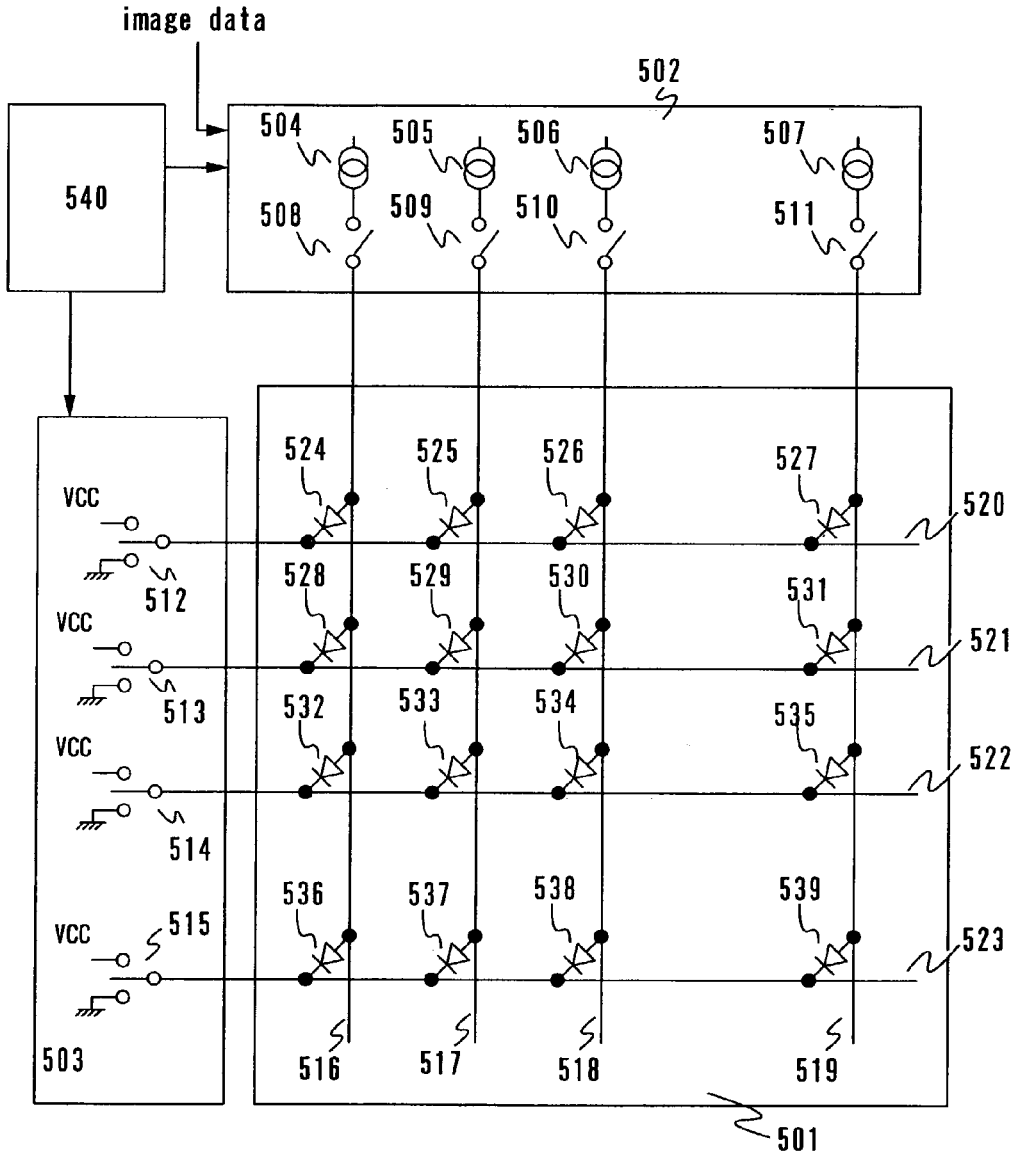
FIG. 5 is a diagram illustrative of a conventional passive matrix light emitting device (in a case of digital gray scale display)
Figure 6:
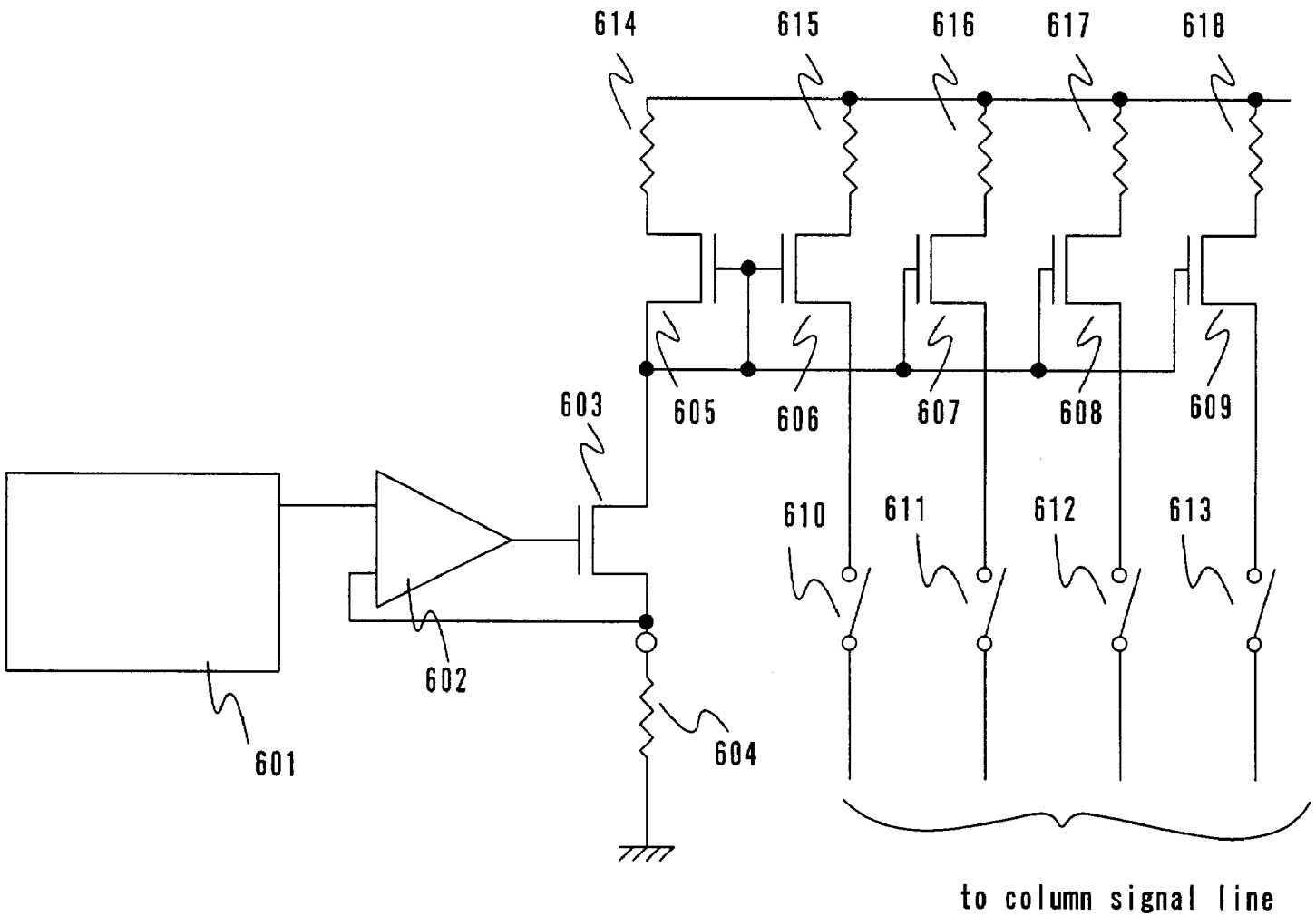
FIG. 6 is a diagram illustrative of a column signal line driver circuit of the conventional passive matrix light emitting device (in a case of digital gray scale display)
Figure 7:
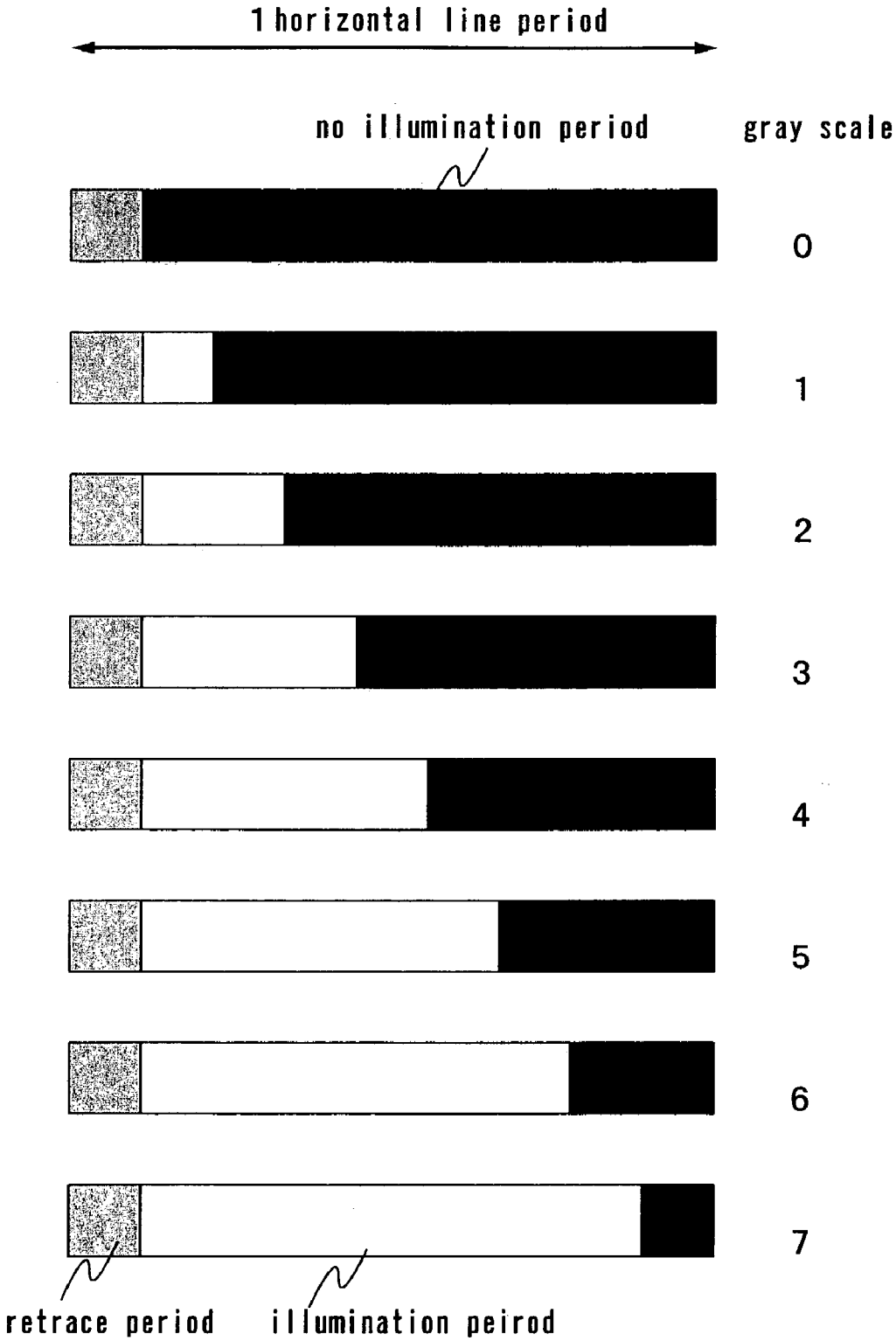
FIG. 7 is a diagram illustrative of a time-division gray scale method.

In the passive matrix light emitting device having the degradation correction function of the present invention, an example in which the degradation correction device and the display device are mounted on the same substrate is shown in FIG. 4A. A column signal line driver circuit 402, a row signal line driver circuit 403, and a degradation correction device 405 are mounted on a substrate 401 having a pixel portion 404 with a known COG technique. FIG. 4B shows an example of an internal block diagram of the degradation correction device 405 shown in FIG. 4A. FIG. 4C shows an internal block diagram of the degradation correction device 405 in a case of the light emitting device (FIG. 13) of the present invention performing analog gray scale display. It is needless to mention that the layout on the substrate is not limited by the examples in the figures, but it is desirable that the respective components are arranged close to each other for each block taking into considerations the arrangement of signal lines etc., the length of wirings, and the like.

A digital image signal (first image signal) 411A is inputted from an externally provided image source to a correction circuit 415 in the degradation correction device 405 via an FPC 406. After that, a digital image signal (second image signal) 411B corrected with the method described in Embodiment Modes 1 and 2 and Embodiments 1 and 2 is inputted to the column signal line driver circuit 402.

It should be noted here that, although not shown in FIG. 4A, a necessary control signal may be inputted to the degradation correction device. In the example shown in FIG. 4, the degradation correction device 405 is disposed between the FPC 406 and the column signal line driver circuit 402, so that the relay of control signals is facilitated.

Embodiment 4

In this embodiment, an external light emitting quantum efficiency can be remarkably improved by using an EL material by which phosphorescence from a triplet exciton can be employed for emitting a light. As a result, the power consumption of the EL element can be reduced, the lifetime of the EL element can be elongated and the weight of the EL element can be lightened.

The following is a report where the external light emitting quantum efficiency is improved by using the triplet exciton (T. Tsutsui, C. Adachi, S. Saito, Photochemical processes in Organized Molecular Systems, ed. K. Honda, (Elsevier Sci. Pub., Tokyo, 1991) p. 437). The molecular formula of an EL material (coumarin pigment) reported by the above article is represented as follows.

(Chemical Formula 1)

The following is another report where the external light emitting quantum efficiency is improved by using the triplet exciton (M. A. Baldo, D. F. O=Brien, Y. You, A. Shoustikov, S. Sibley, M. E. Thompson, S. R. Forrest, Nature 395 (1998) p.151)

The molecular formula of an EL material (Pt complex) reported by the above article is represented as follows.

(Chemical Formula 2)

The following is another report where the external light emitting quantum efficiency is improved by using the triplet exciton (M. A. Baldo, S. Lamansky, P. E. Burrows, M. E. Thompson, S. R. Forrest, Appl. Phys. Lett., 75 (1999) p.4.), (T. Tsutsui, M. -J. Yang, M. Yahiro, K. Nakamura, T. Watanabe, T. Tsuji, Y. Fukuda, T. Wakimoto, S. Mayaguchi, Jpn, Appl. Phys., 38 (12B) (1999) L1502)

The molecular formula of an EL material (Ir complex) reported by the above article is represented as follows.

(Chemical Formula 3)

As described above, if phosphorescence from a triplet exciton can be put to practical use, it can realize the external light emitting quantum efficiency three to four times as high as that in the case of using fluorescence from a singlet exciton in principle. The structure according to this embodiment can be freely implemented in combination of any structures of embodiment 1 to 3.

Embodiment 5

A passive matrix type EL display which is an application of the passive matrix type light emitting device of the present invention has superior visibility to a liquid crystal display in bright locations because it is of a self-luminous type, and moreover viewing angle is wide. Accordingly, it can be used as a display portion for various electronics Note that all displays exhibiting (displaying) information such as a personal computer display, a TV broadcast reception display, or an advertisement display are included as the passive matrix type EL display. Further, the light emitting device of the present invention can be used as a display portion of the other various electronics.

The following can be given as examples of such electronics: an image camera; a digital camera; a goggle type display (head mounted display); a car navigation system; an audio reproducing device (such as a car audio system, an audio compo system); a laptop; a game equipment; a portable information terminal (such as a mobile computer, a cellular phone, a mobile game equipment or an electronic book etc.); and an image reproducer provided with a recording medium (specifically, a device which reproduces a recording medium and is provided with a display which can display those images, such as a digital image disk (DVD) etc.). In particular, because portable information terminals are often viewed from a diagonal direction, the wideness of the field of vision is regarded as very important. Thus, it is preferable that the EL display is employed. Examples of these electronics are shown in FIGS. 11 and 12

Figure 11A:
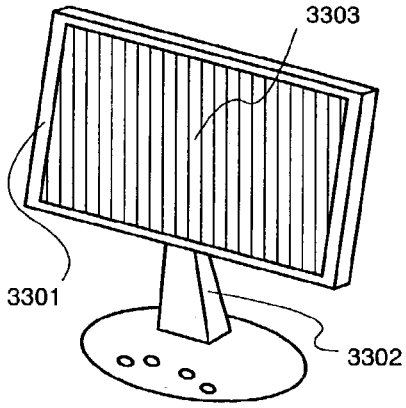
FIGS. 11A to 11F are diagrams showing an example of the light emitting device having a degradation correction function of the present invention applied to an electronic equipment.

FIG. 11A illustrates an EL display which includes a frame 3301, a support table 3302, a display portion 3303, or the like. The light emitting device in accordance with the present invention can be used in the display portion 3303. A back light is not needed because the EL display is of a self-luminous type, so the display portion can be thinner than a liquid crystal display device.

Figure 11B:
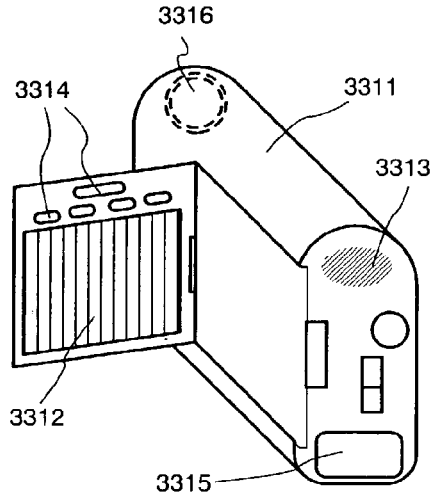

FIG. 11B illustrates an image camera which includes a main body 3311, a display portion 3312, an audio input portion 3313, operation switches 3314, a battery 3315, an image receiving portion 3316, or the like. The light emitting device in accordance with the present invention can be used in the display portion 3312.

Figure 11C:
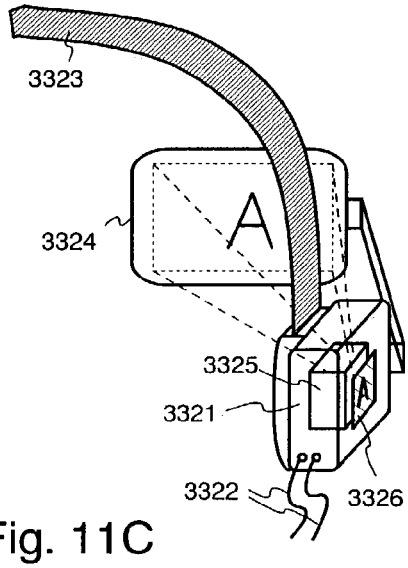

FIG. 11C illustrates a portion (the right-half piece) of a head-mounted EL display which includes a main body 3321, signal cables 3322, a head mount band 3323, a display portion 3324, an optical system 3325, a display device 3326, or the like. The light emitting device in accordance with the present invention can be used in the display device 3326.

Figure 11D:
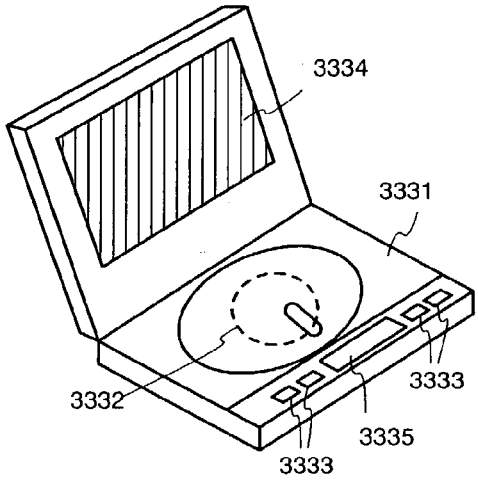

FIG. 11D illustrates an image reproduction device which includes a recording medium (more specifically, a DVD reproduction device), which includes a main body 3331, a recording medium (a DVD or the like) 3332, operation switches 3333, a display portion (a) 3334, another display portion (b) 3335, or the like. The display portion (a) 3334 is used mainly for displaying image information, while the display portion (b) 3335 is used mainly for displaying character information. The light emitting device in accordance with the present invention can be used in these display portions (a) 3334 and (b) 3335. The image reproduction device including a recording medium further includes a domestic game equipment or the like.

Figure 11E:
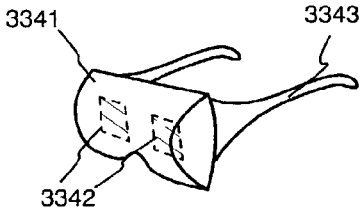

FIG. 11E illustrates a goggle type display (head-mounted display) which includes a main body 3341, a display portion 3342, an arm portion 3343. The light emitting device in accordance with the present invention can be used in the display portion 3342.

Figure 11F:
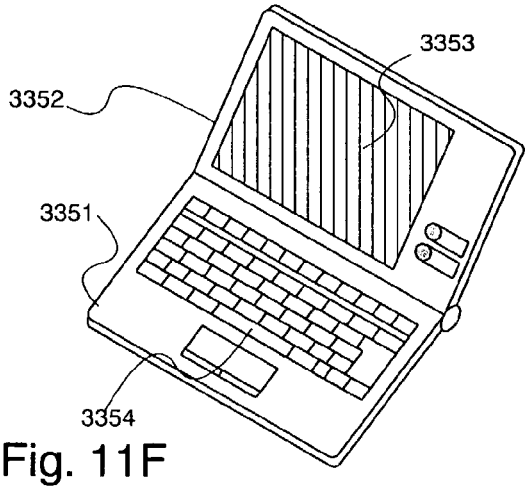

FIG. 11F illustrates a personal computer which includes a main body 3351, a frame 3352, a display portion 3353, a key board 3354, or the like. The light emitting device of the present invention can be used in the display portion 3353.

Note that if emission luminance of an EL material becomes higher in the future, it will be applicable to a front-type or rear-type projector in which light including output image information is enlarged by means of lenses or the like to be projected.

The above mentioned electronics are more likely to be used for display information distributed through a electronic communication line such as Internet, a CATV (cable television system), and in particular likely to display moving picture information. The EL display is suitable for displaying moving pictures since the EL material can exhibit high response speed.

Further, since a light emitting portion of the EL display consumes power, it is desirable to display information in such a manner that the light emitting portion therein becomes as small as possible. Accordingly, when the EL display is applied to a display portion which mainly displays character information, e.g., a display portion of a portable information terminal, and more particular, a cellular phone or an audio reproducing device, it is desirable to drive the EL display so that the character information is formed by a light-emitting portion while a non-emission portion corresponds to the background.

Figure 12A:
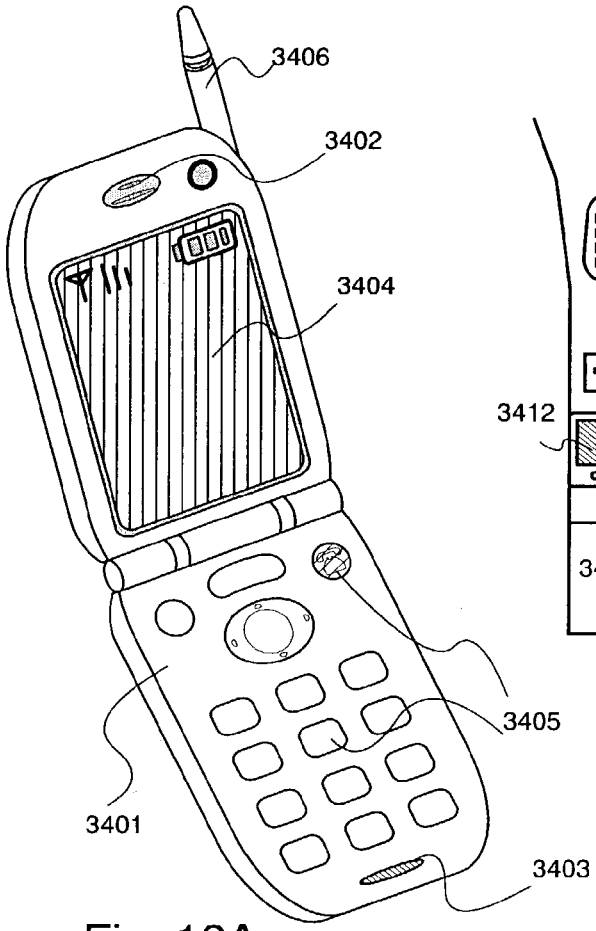
FIGS. 12A to 12C are diagrams showing an example of the light emitting device having a degradation correction function of the present invention applied to an electronic equipment.

FIG. 12A illustrates a cellular phone which includes a main body 3401, an audio output portion 3402, an audio input portion 3403, a display portion 3404, operation switches 3405, and an antenna 3406. The light emitting device in accordance with the present invention can be used in the display portion 3404. Note that the display portion 3404 can reduce power consumption of the cellular phone by displaying white-colored characters on a black-colored background.

Figure 12B:
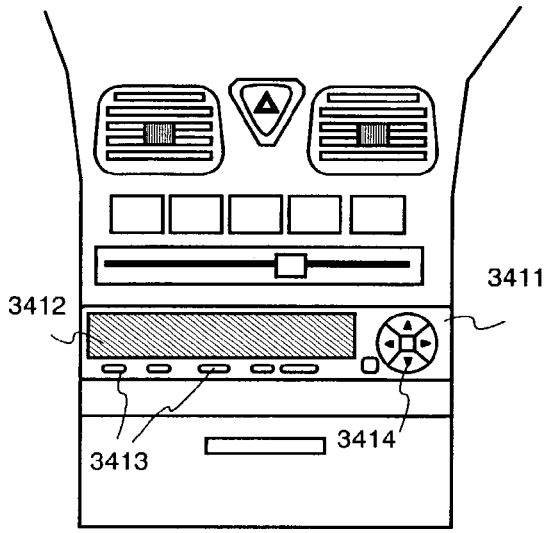

Further, FIG. 12B illustrates an audio reproducing device, specifically, a car audio system, which includes a main body 3411, a display portion 3412, and operation switches 3413 and 3414. The light emitting device in accordance with the present invention can be used in the display portion 3412. Although the car audio system of the mount type is shown in the present embodiment, the present invention is also applicable to a portable type or domestic audio reproducing device. The display portion 3414 can reduce power consumption by displaying white-colored characters on a black-colored background, which is particularly advantageous for the portable type audio reproduction device.

Figure 12C:
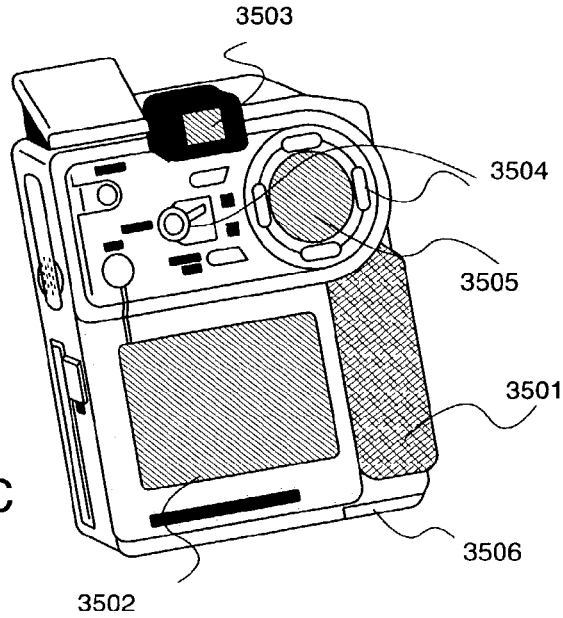

FIG. 12C illustrates a digital camera which includes a main body 3501, a display portion (A) 3502, a view finder portion 3503, operation switches 3504, a display portion (B) 3505, and a battery 3506. The electro-optic device of the present invention can be used in the display portions (A) 3502 and (B) 3505.

As set forth above, the present invention can be applied variously to a wide range of electronics in all fields. The electronics in the present embodiment may use any one of configurations shown in Embodiments 1 to 4.

With the light emitting device of the present invention, it is possible to provide a light emitting device capable of correcting on the circuit side the degradation of an light emitting element due to the long illumination time, and performing display with the uniformity across the screen without the occurrence of brightness variance.

What is claimed is:

1. A passive matrix light emitting device comprising:

means for detecting an accumulated illumination time in each pixel;

means for storing the accumulated illumination time;

means for correcting an image signal in accordance with the accumulated illumination time stored; and means for controlling a reference current in a column signal line driver circuit in accordance with the accumulated illumination time, wherein the corrected image signal is used to display an image, and wherein the pixel comprises a light emitting element connected to a row signal line and a column signal line.

2. A passive matrix light emitting device comprising:

means for detecting an accumulated illumination time and an illumination intensity in each pixel;

means for storing the accumulated illumination time and the illumination intensity;

means for correcting an image signal in accordance with the accumulated illumination time and the illumination intensity which are stored; and means for controlling a reference current in a column signal line driver circuit in accordance with the accumulated illumination time, wherein the corrected image signal is used to display an image, and wherein the pixel comprises a light emitting element connected to a row signal line and a column signal line.

3. A passive matrix light emitting device comprising:

a degradation correction device including:

detection means having a counter unit that samples a first image signal and periodically detects an illumination time of a self-luminous element in each pixel;

storage means having a storage circuit unit that accumulates the illumination time of the self-luminous element in each pixel detected by the counter unit and stores the accumulated illumination time;

correction means having a signal correction unit that corrects the first image signal in accordance with the accumulated illumination time of the self-luminous element in each pixel stored in an accumulated form in the storage circuit unit and outputs a second image signal; and control means which controls a reference current in a column signal line driver circuit in accordance with the accumulated illumination time; and a display device that displays the image based on the second image signal, wherein the pixel comprises a light emitting element connected to a row signal line and a column signal line.

4. A passive matrix light emitting device comprising:

a degradation correction device including:

detection means having a counter unit that samples a first image signal and periodically detects an illumination time and illumination intensity of a self-luminous element in each pixel;

storage means having a storage circuit unit that accumulates the illumination time and illumination intensity of the self-luminous element in each pixel detected by the counter unit and stores the accumulated illumination time and illumination intensity;

correction means having a signal correction unit that corrects the first image signal in accordance with the accumulated illumination time and illumination intensity of the self-luminous element in each pixel stored in the storage circuit unit and outputs a second image signal; and control means which controls a reference current in a column signal line driver circuit in accordance with the accumulated illumination time; and a display device that displays the image based on the second image signal, wherein the pixel comprises a light emitting element connected to a row signal line and a column signal line.

5. A passive matrix light emitting device according to claim 1, wherein the corrected image signal is converted into an analog image signal, and the analog image signal is used to display the image.

6. A passive matrix light emitting device according to claim 2, wherein the corrected image signal is convened into an analog image signal, and the analog image signal is used to display the image.

7. A passive matrix light emitting device according to claim 3, further comprising a display device that converts the second image signal into an analog image signal to display an image based on the analog image signal.

8. A passive matrix light emitting device according to claim 4, further comprising a display device that converts the second image signal into an analog image signal to display an image based on the analog image signal.

9. A passive matrix light emitting device according to claim 1, wherein:

the light emitting device that performs an n-bit (n is a natural number n≧2) gray scale display further comprises a driver circuit that performs an (n+m)-bit (m is a natural number) signal processing; and an image signal that is to be written into a pixel having a non-degraded self-luminous element is an n-bit image signal used to perform a gray scale display, and an image signal That is to be written into a pixel having a degraded self-luminous element is subjected to a gray scale addition processing by using an m-bit signal to thereby make a brightness of the non-degraded self-luminous element and a brightness of the degraded self-luminous element equal to each other.

10. A passive matrix light emitting device according to claim 2, wherein:

the light emitting device that performs an n-bit (n is a natural number n≧2) gray scale display further comprises a driver circuit that performs an (n+m)-bit (m is a natural number) signal processing; and an image signal that is to be written into a pixel having a non-degraded self-luminous element is an n-bit image signal used to perform a gray scale display, and an image signal that is to be written into a pixel having a degraded self-luminous element is subjected to a gray scale addition processing by using an m-bit signal to thereby make a brightness of the non-degraded self-luminous element and a brightness of the degraded self-luminous element equal to each other.

11. A passive matrix light emitting device according to claim 3, wherein:

the light emitting device that performs an n-bit (n is a natural number n≧2) gray scale display further comprises a driver circuit that performs an (n+m)-bit (m is a natural number) signal processing; and an image signal that is to be written into a pixel having a non-degraded self-luminous element is an n-bit image signal used to perform a gray scale display, and an image signal that is to be written into a pixel having a degraded self-luminous element is subjected to a gray scale addition processing by using an m-bit signal to thereby make a brightness of the non-degraded self-luminous element and a brightness of the degraded self-luminous element equal to each other.

12. A passive matrix light emitting device according to claim 4, wherein:

the light emitting device tat performs an n-bit (n is a natural number, n≧2) gray scale display further comprises a driver circuit that performs an (n+m)-bit (m is a natural number) signal processing; and an image signal that is to be written into a pixel having a non-degraded self-luminous element is an n-bit image signal used to perform a gray scale display, and an image signal that is to be written into a pixel having a degraded self-luminous element is subjected to a gray scale addition processing by using an m-bit signal to thereby make a brightness of the non-degraded self-luminous element and a brightness of the degraded self-luminous element equal to each other.

13. A passive matrix light emitting device according to claim 1, wherein the correction means performs an addition processing to an image signal that is to be written into a pixel having a degraded self-luminous element relatively to an image signal that is to be written into a pixel having a non-degraded self-luminous element.

14. A passive matrix light emitting device according to claim 2, wherein the correction means performs an addition processing to an image signal that is to be written into a pixel having a degraded self-luminous element relatively to an image signal that is to be written into a pixel having a non-degraded self-luminous element.

15. A passive matrix light emitting device according to claim 3, wherein the correction means performs an addition processing to an image signal that is to be written into a pixel having a degraded self-luminous element relatively to an image signal that is to be written into a pixel having a non-degraded self-luminous element.

16. A passive matrix light emitting device according to claim 4, wherein the correction means performs an addition processing to an image signal that is to be written into a pixel having a degraded self-luminous element relatively to an image signal that is to be written into a pixel having a non-degraded self-luminous element.

17. A passive matrix light emitting device according to claim 1, wherein the correction means performs, within a display range, a subtraction processing to an image signal that is to be written into a pixel having a slightly degraded self-luminous element or a non-degraded self-luminous element relatively to an image signal that is to be written into a pixel having a most degraded self-luminous element.

18. A passive matrix light emitting device according to claim 2, wherein the correction means performs, within a display range, a subtraction processing to an image signal that is to be written into a pixel having a slightly degraded self-luminous element or a non-degraded self-luminous element relatively to an image signal that is to be written into a pixel having a most degraded self-luminous element.

19. A passive matrix light emitting device according to claim 3, wherein the correction means performs, within a display range, a subtraction processing to an image signal that is to be written into a pixel having a slightly degraded self-luminous element or a non-degraded self-luminous element relatively to an image signal that is to be written into a pixel having a most degraded self-luminous element.

20. A passive matrix light emitting device according to claim 4, wherein the correction means performs, within a display range, a subtraction processing to an image signal tat is to be written into a pixel having a slightly degraded self-luminous element or a non-degraded self-luminous element relatively to an image signal that is to be written into a pixel having a most degraded self-luminous element.

21. A passive matrix light emitting device according to claim 1, wherein the storage means has a static random access memory (SRAM).

22. A passive matrix light emitting device according to claim 2, wherein the storage means has a static random access memory (SRAM).

23. A passive matrix light emitting device according to claim 3, wherein the storage means has a static random access memory (SRAM).

24. A passive matrix light emitting device according to claim 4, wherein the storage means has a static random access memory (SRAM).

25. A passive matrix light emitting device according to claim 1, wherein the storage means has a dynamic random access memory (DRAM).

26. A passive matrix light emitting device according to claim 2, wherein the storage means has a dynamic random access memory (DRAM).

27. A passive matrix light emitting device according to claim 3, wherein the storage means has a dynamic random access memory (DRAM).

28. A passive matrix light emitting device according to claim 4, wherein the storage means has a dynamic random access memory (DRAM).

29. A passive matrix light emitting device according to claim 1, wherein the storage means has a ferroelectric random access memory (FRAM).

30. A passive matrix light emitting device according to claim 2, wherein the storage means has a ferroelectric random access memory (FRAM).

31. A passive matrix light emitting device according to claim 3, wherein the storage means has a ferroelectric random access memory (FRAM).

32. A passive matrix light emitting device according to claim 4, wherein the storage means has a ferroelectric random access memory (FRAM).

33. A passive matrix light emitting device according to claim 1, wherein the detection means, the storage means, and the correction means are structured by an external circuit that is formed outside the passive matrix light emitting device.

34. A passive matrix light emitting device according to claim 2, wherein the detection means, the storage means, and the correction means are structured by an external circuit that is formed outside the passive matrix light emitting device.

35. A passive matrix light emitting device according to claim 3, wherein the detection means, the storage means, and the correction means are structured by an external circuit that is formed outside the passive matrix light emitting device.

36. A passive matrix light emitting device according to claim 4, wherein the detection means, the storage means, and the correction means are structured by an external circuit that is formed outside the passive matrix light emitting device.

37. A passive matrix light emitting device according to claim 1, wherein the detection means, the storage means, and the correction means are mounted on an identical insulator on which the light emitting device is mounted.

38. A passive matrix light emitting device according to claim 2, wherein the detection means, the storage mews, and the correction means are mounted on an, identical insulator on which the light emitting device is mounted.

39. A passive matrix light emitting device according to claim 3, wherein the detection means, the storage means, and the correction means are mounted on an identical insulator on which the light emitting device is mounted.

40. A passive matrix light emitting device according to claim 4, wherein the detection means, the storage means, and the correction means are mounted on an identical insulator on which the light emitting device is mounted.

41. A passive matrix light emitting device according to claim 1, wherein the light emitting device comprises a passive matrix EL display.

42. A passive matrix light emitting device according to claim 2, wherein the light emitting device comprises a passive matrix EL display.

43. A passive matrix light emitting device according to claim 3, wherein the light emitting device comprises a passive matrix EL display.

44. A passive matrix light emitting device according to claim 4, wherein the light emitting device comprises a passive matrix EL display.

45. A passive matrix light emitting device according to claim 1, wherein the light emitting device is at least one selected from the group consisting of a video camera, a head-mount EL display, a DVD player, a goggle type display, a front-type or rear-type projector, a cellular phone, a car audio system and a digital camera.

46. A passive matrix light emitting device according to claim 2, wherein the light emitting device is at least one selected from the group consisting of a video camera, a head-mount EL display, a DVD player, a goggle type display, a front-type or rear-type projector, a cellular phone, a vat audio system and a digital camera.

47. A passive matrix light emitting device according to claim 3, wherein the light emitting device is at least one selected from the group consisting of a video camera, a head-mount EL display, a DVD player, a goggle type display, a front-type or rear-type projector, a cellular phone, a car audio system and a digital camera.

48. A passive matrix light emitting device according to claim 4, wherein the light emitting device is at least one selected from the group consisting of a video camera, a head-mount EL display, a DVD player, a goggle type display, a front-type or rear-type projector, a cellular phone, a car audio system and a digital camera.

* * * * *